US009821558B2

(12) United States Patent
Ono

(10) Patent No.: US 9,821,558 B2
(45) Date of Patent: Nov. 21, 2017

(54) LIQUID CARTRIDGE PROVIDED WITH PROTECTION PROTRUSION

(71) Applicant: BROTHER KOGYO KABUSHIKI KAISHA, Nagoya-shi, Aichi-ken (JP)

(72) Inventor: Akihito Ono, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/235,402

(22) Filed: Aug. 12, 2016

(65) Prior Publication Data

US 2017/0066248 A1 Mar. 9, 2017

(30) Foreign Application Priority Data

Sep. 7, 2015 (JP) ..... 2015-176105

(51) Int. Cl.
*B41J 2/175* (2006.01)

(52) U.S. Cl.
CPC ..... *B41J 2/1752* (2013.01); *B41J 2/1753* (2013.01); *B41J 2/17509* (2013.01); *B41J 2/17513* (2013.01); *B41J 2/17523* (2013.01); *B41J 2/17553* (2013.01); *B41J 2/17566* (2013.01); *B41J 2002/17576* (2013.01)

(58) Field of Classification Search
CPC ..... B41J 2/1752
USPC ..... 347/86
See application file for complete search history.

(56) References Cited

U.S. PATENT DOCUMENTS

2003/0030698 A1* 2/2003 Ikegame ..... B41J 2/14024 347/47
2003/0035035 A1* 2/2003 Komplin ..... B41J 2/17553 347/86
2008/0231675 A1* 9/2008 Hattori ..... B41J 2/17513 347/86
2013/0182053 A1* 7/2013 Kodama ..... B41J 2/17523 347/86

FOREIGN PATENT DOCUMENTS

JP 2008-221803 A 9/2008

* cited by examiner

*Primary Examiner* — Huan Tran
*Assistant Examiner* — Alexander D Shenderov
(74) *Attorney, Agent, or Firm* — Merchant & Gould P.C.

(57) ABSTRACT

A liquid cartridge includes: a cartridge body having a first surface facing in a first direction; an accessed part disposed on the first surface; and a first protrusion protruding from the first surface in the first direction. The first surface has a first end in a second direction orthogonal to the first direction and a second end in a third direction opposite the second direction. The first protrusion is disposed on the first surface at a position closer to the first end than the accessed part is to the first end, the first protrusion having a first protruding end positioned further in the first direction relative to the accessed part, the first protrusion being tapered toward the first protruding end, the first protrusion having a sloped surface that faces in the third direction toward the accessed part and slopes away from the accessed part toward the first protruding end.

23 Claims, 7 Drawing Sheets

LIQUID CARTRIDGE PROVIDED WITH PROTECTION PROTRUSION

CROSS REFERENCE TO RELATED APPLICATION

This application claims priority from Japanese Patent Application No. 2015-176105 filed Sep. 7, 2015. The entire content of the priority application is incorporated herein by reference.

TECHNICAL FIELD

The present disclosure relates to a liquid cartridge that stores liquid therein.

BACKGROUND

There is known a liquid cartridge formed of resin. If such resin liquid cartridge falls on a floor and is applied with impact, a protrusion and an IC chip provided on an outer edge of the liquid cartridge may be damaged due to the impact.

Japanese Patent Application Publication No. 2008-221803 discloses an ink cartridge provided with a wrong-insertion preventing protrusion and a protection protrusion provided on an outer edge of the liquid cartridge. The protection protrusion is provided near the wrong-insertion preventing protrusion so that the wrong-insertion preventing protrusion can be prevented from getting deformed due to the impact applied thereto at the time of falling of the ink cartridge.

SUMMARY

In the above-described ink cartridge, the protection protrusion itself may also be deformed due to the impact applied thereto at the time of falling of the ink cartridge. Such deformation of the protection protrusion may possibly incur various problems. For example, insertion of the ink cartridge into a printer may be hindered due to the deformation of the protection protrusion. Or, in case that a protection protrusion is provided for protecting an IC chip, deformation of such protection protrusion may impede establishment of an electrical connection between the IC chip and a connector provided on the printer when the ink cartridge is mounted in the printer.

In view of the foregoing, it is an object of the present disclosure to provide a liquid cartridge having such a structure that deformation of a protrusion for protecting an accessed part has little effect on accessing to the accessed part.

In order to attain the above and other objects, the present disclosure provides a liquid cartridge including a cartridge body, an accessed part and a first protrusion. The cartridge body has a first surface facing in a first direction, the first surface having a first end in a second direction orthogonal to the first direction and a second end in a third direction opposite the second direction. The accessed part is disposed on the first surface and is configured to be accessed from outside. The first protrusion is disposed on the first surface at a position closer to the first end than the accessed part is to the first end, the first protrusion protruding from the first surface in the first direction and having a first protruding end positioned further in the first direction relative to the accessed part, the first protrusion being tapered toward the first protruding end, the first protrusion having a sloped surface that faces in the third direction toward the accessed part and slopes away from the accessed part toward the first protruding end.

According to another aspect, the present disclosure provides a liquid cartridge including a front surface, a rear surface opposite the front surface, an upper surface, a first side surface, a second side surface, an accessed part and a first protrusion. The first side surface extends between the front surface and the rear surface, the first side surface facing in a second direction orthogonal to the first direction. The second side surface is opposite the first side surface and face in a third direction opposite the second direction. The accessed part is disposed on the upper surface and is configured to be accessed from outside, the accessed part having an accessed surface facing in the first direction. The first protrusion is disposed on the upper surface at a position closer to the first side surface than the accessed part is to the first side surface, the first protrusion having a base end connected to the upper surface and a protruding end opposite the base end, the first protrusion being tapered from the base end toward the protruding end such that a distance between the protruding end and the accessed part in the second direction is longer than a distance between the base end and the accessed part in the second direction.

DETAILED DESCRIPTION

Figure 1:
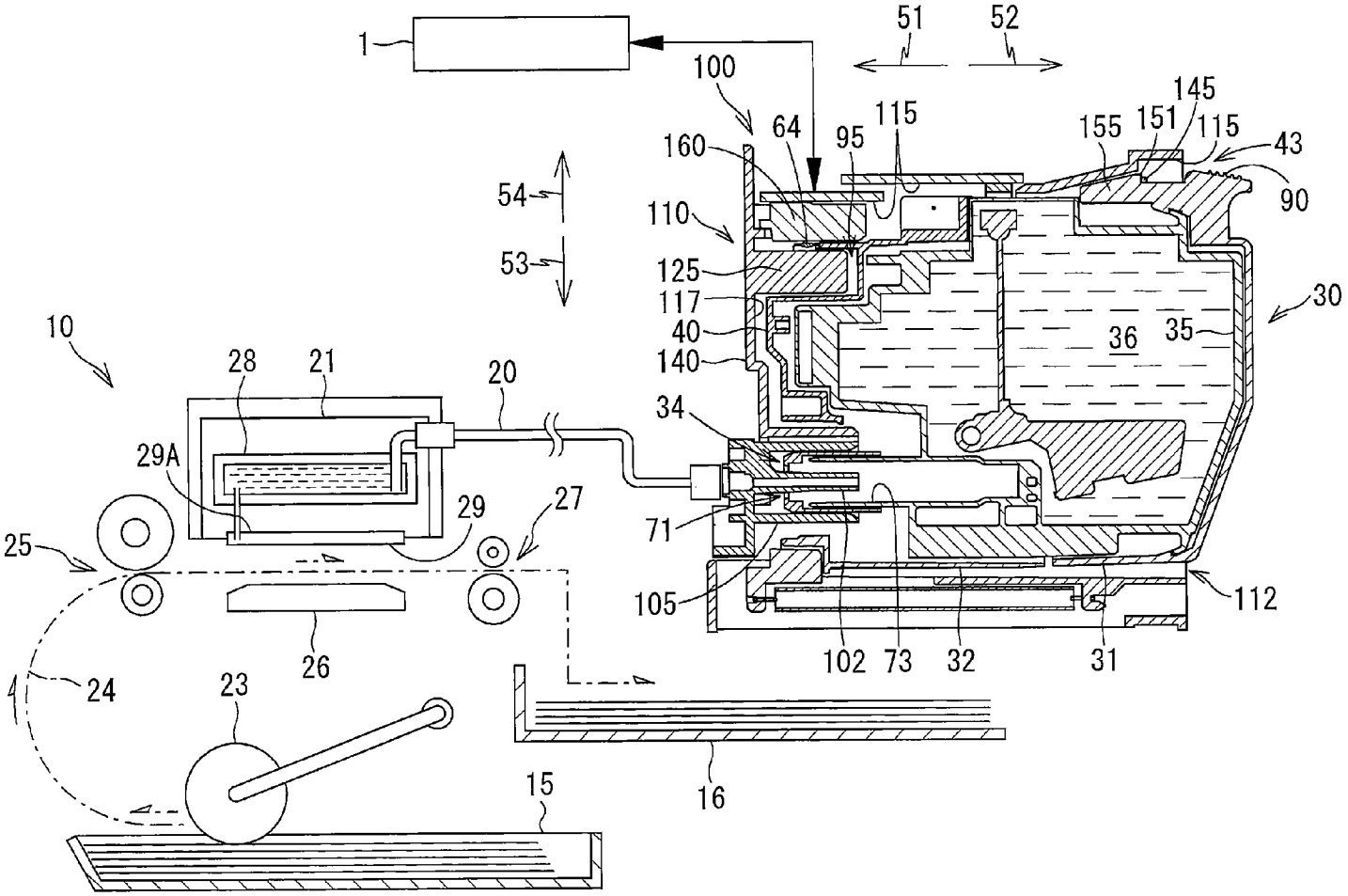
FIG. 1 is a conceptual cross-sectional view showing an internal construction of a printer 10 provided with a cartridge-receiving section 110 that detachably accommodates an ink cartridge according to an embodiment of the present disclosure.

An ink cartridge 30 according to an embodiment of the present disclosure will be described while referring to FIGS. 1 through 6. While the disclosure is described below in detail with reference to this embodiment, it would be apparent to those skilled in the art that many modifications and variations may be made therein without departing from the spirit of the disclosure.

In the following description, a mounting direction 51 is defined as a direction that the ink cartridge 30 is inserted into a cartridge-receiving section 110, and a removing direction 52 is defined as a direction opposite the mounting direction 51, that is, a direction in which the ink cartridge 30 is extracted from the cartridge-receiving section 110. While the mounting and removing directions 51 and 52 are horizontal directions in the present embodiment, the mounting and removing directions 51 and 52 need not be horizontal directions. The mounting direction 51 is an example of a fourth direction.

Further, an upward direction 54 is defined as a direction perpendicular to the mounting and removing directions 51 and 52, and a downward direction 53 is defined as a direction opposite the upward direction 54. While the upward direction 54 is vertically upward and the downward direction 53 is vertically downward in the present embodiment, the upward and downward directions 54 and 53 need not be vertical directions. The upward direction 54 is an example of a first direction. The downward direction 53 is an example of an opposing direction.

Further, a rightward direction 55 and a leftward direction 56 are defined as directions perpendicular to the mounting direction 51 and the downward direction 53. More specifically, when the ink cartridge 30 has been inserted into the cartridge-receiving section 110, i.e., when the ink cartridge 30 is in an operational state, and when a user views the ink cartridge 30 in the mounting direction 51, the rightward direction 55 is a direction toward the right and the leftward direction 56 is a direction opposite the rightward direction 55 and toward the left. While the rightward and leftward directions 55 and 56 are horizontal directions in the present embodiment, the rightward and leftward directions 55 and 56 need not be horizontal directions. The rightward direction 55 is an example of a third direction, and the leftward direction 56 is an example of a second direction. Alternatively, the rightward direction 55 can be an example of the second direction, and the leftward direction 56 can be an example of the third direction.

<Overview of Printer 10>

First, a printer 10 adapted to use the ink cartridge 30 will be described with reference to FIG. 1.

The printer 10 is configured to form an image by ejecting ink droplets onto a sheet based on an ink jet recording system. As shown in FIG. 1, the printer 10 includes a recording head 21, an ink-supplying device 100 and an ink tube 20 connecting the recording head 21 to the ink-supplying device 100. The ink-supplying device 100 includes a cartridge-receiving section 110. The ink cartridge 30 (an example of a liquid cartridge) can be detachably accommodated in the cartridge-mounting section 110.

The cartridge-receiving section 110 has one side formed with an opening 112. The ink cartridge 30 can be inserted into the cartridge-mounting section 110 in the mounting direction 51 through the opening 112 and extracted from the cartridge-receiving section 110 in the removing direction 52 through the opening 112.

The ink cartridge 30 stores ink therein that the printer 10 can use for printing. The ink cartridge 30 is connected to the recording head 21 through the ink tube 20 when the ink cartridge 30 has been completely mounted in the cartridge-receiving section 110.

In the printer 10 of the present embodiment, the cartridge-receiving section 110 can accommodate therein four kinds of ink cartridges 30 corresponding to four colors of cyan, magenta, yellow and black, respectively. However, for simplifying explanation, only one ink cartridge 30 is assumed to be mounted in the cartridge-receiving section 110 in FIG. 1 and explanations therefor.

The recording head 21 has a sub tank 28 for temporarily storing ink supplied from the ink cartridge 30 through the ink tube 20. The recording head 21 also includes a plurality of nozzles 29 through which the ink supplied from the sub tank 28 is selectively ejected in accordance with the ink jet recording system. More specifically, the recording head 21 includes a head control board (not shown), and piezoelectric elements 29A corresponding one-on-one to the nozzles 29. The head control board is configured to selectively apply drive voltages to the piezoelectric elements 29A in order to eject ink selectively from the nozzles 29.

The printer 10 also includes a sheet tray 15, a sheet feeding roller 23, a conveying path 24, a pair of conveying rollers 25, a platen 26, a pair of discharge rollers 27, and a sheet discharge tray 16. The sheet feeding roller 23 is configured to feed sheets of paper from the sheet tray 15 onto the conveying path 24, and the conveying rollers 25 are configured to convey the sheets over the platen 26. The recording head 21 is configured to selectively eject ink onto the sheets as the sheets passes over the platen 26, whereby images are recorded on the sheets. That is, the ink stored in the ink cartridge 30 that has been completely mounted in the cartridge-mounting section 110 can be consumed by the recording head 21. The discharge rollers 27 are adapted to receive the sheets that have passed over the platen 26 and are configured to discharge the sheets onto the sheet discharge tray 16 disposed on a downstream end of the conveying path 24.

<Ink-Supplying Device 100>

The ink-supplying device 100 is provided in the printer 10, as shown in FIG. 1. The ink-supplying device 100 functions to supply ink to the recording head 21. As described above, the ink-supplying device 100 includes the cartridge-receiving section 110 in which the ink cartridge 30 is detachable mountable. FIG. 1 shows a state where the ink cartridge 30 has been completely received in the cartridge-receiving section 110.

<Cartridge-Receiving Section 110>

Figure 2:
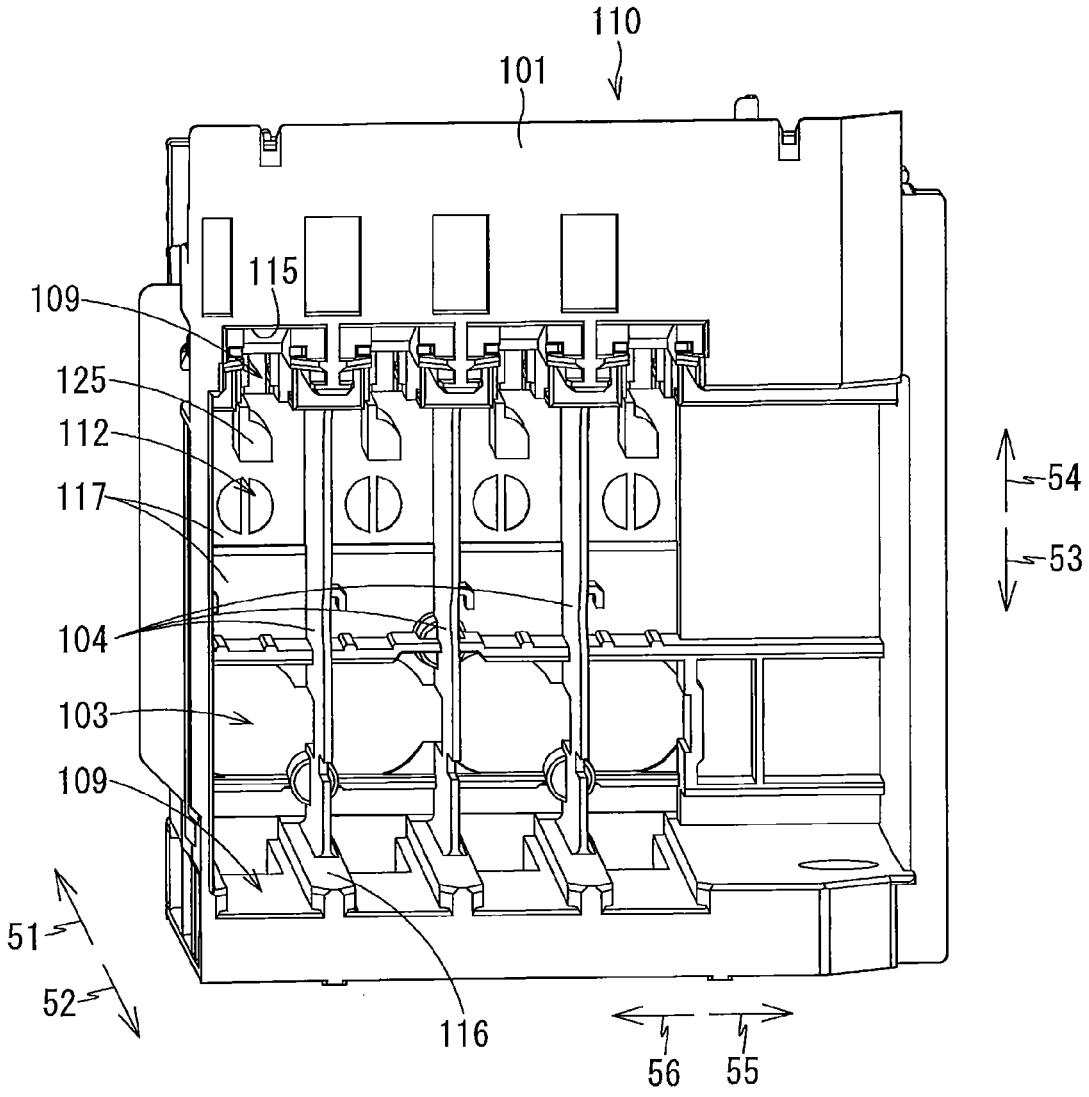
FIG. 2 is a perspective view showing an external appearance of the cartridge-receiving section 110.

The cartridge-receiving section 110 includes a case 101, and four sets of an ink needle 102, a lock part 145, a contact unit 160 and a protrusion 125 to correspond to the four kinds of the ink cartridges 30 mountable in the cartridge-receiving section 110. The four ink needles 102, four lock parts 145, four contact units 160 and four protrusions 125 are, respectively, aligned with one another in the rightward direction 55 and leftward direction 56. Further, the four ink needles 102, four lock parts 145, four contact units 160 and four protrusions 125, respectively, have the same configurations as one another. Hence, hereinafter, only one each of the four ink needles 102, four lock parts 145, four contact units 160 and four protrusions 125 will be described, while descriptions for remaining three each thereof will be omitted. In FIG. 2, the ink needles 102, lock parts 145, and contact units 160 are omitted from the drawing.

<Case 101>

The case 101 defines an outer shape of the cartridge-receiving section 110. The case 101 has a box-like shape and defines an internal space therein. Specifically, the case 101 includes a top wall 115, a bottom wall 116, and an end wall 117 connecting the top wall 115 and the bottom wall 116. The case 101 is formed with the opening 112. Specifically, the top wall 115 and the bottom wall 116 define a ceiling and a bottom of the internal space of the case 101, respectively. The end wall 117 defines an end of the internal space of the case 101 in the mounting direction 51 to be arranged oppose the opening 112 in the mounting direction 51 and removing direction 52. The opening 112 is exposed to a surface (user interface surface) that a user can face when using the printer 10.

As show in FIG. 2, the top wall 115 is formed with four upper guide grooves 109 aligned with each other in the rightward and leftward directions 55 and 56, while the bottom wall 116 is formed with four lower guide grooves 109 aligned with each other in the rightward and leftward directions 55 and 56. When the ink cartridge 30 is inserted into and removed from the case 101 through the opening 112, upper and lower portions of the ink cartridge 30 are respectively guided by the corresponding upper and lower guide grooves 109 in the mounting direction 51 and removing direction 52. The case 101 further includes three plates 104 partitioning the internal space of the case 101 into four individual spaces. Each space is elongated vertically. The ink cartridge 30 can be detachably accommodated in the corresponding space defined in the case 101.

<Ink Needle 102>

The ink needle 102 is formed of resin and has a generally tubular shape. The ink needle 102 is disposed in a corresponding opening 103 (see FIG. 2) formed in a lower end portion of the end wall 117 of the case 101. The ink needle 102 is disposed at the end wall 117 at a position corresponding to an ink supply part 34 (described later) of the ink cartridge 30 mounted in the cartridge-receiving section 110. The ink needle 102 extends (protrudes) in the removing direction 52 from the end wall 117.

A cylindrical-shaped guide part 105 is provided to surround the ink needle 102. The guide part 105 protrudes in the removing direction 52 from the end wall 117 and has a protruding end that is open. Specifically, the ink needle 102 is positioned at a center of the guide part 105. The guide part 105 is thus formed to allow the ink supply part 34 of the ink cartridge 30 to be received in the guide part 105.

During insertion of the ink cartridge 30 into the cartridge-receiving section 110 in the mounting direction 51, i.e., in the course of movement of the ink cartridge 30 being received in the cartridge-receiving section 110, the ink supply part 34 of the ink cartridge 30 enters into the corresponding guide part 105. As the ink cartridge 30 is inserted further in the mounting direction 51, the ink needle 102 enters into an ink supply port 71 (see FIG. 2) of the ink supply part 34, thereby connecting the ink needle 102 and the ink supply part 34. Hence, the ink stored in an ink chamber 36 (described later, see FIG. 1) formed in the ink cartridge 30 can flow into an internal space formed in the ink tube 20 connected to the ink needle 102 through an internal space of a cylindrical wall 73 (see FIG. 5) constituting the ink supply part 34. The ink needle 102 may have a flat-shaped tip end or a pointed tip end.

<Lock Part 145>

As shown in FIG. 1, the lock part 145 is provided near the top wall 115 constituting the case 101, and near the opening 112. The lock part 145 is arranged to extend in the leftward direction 56 and rightward direction 55. The lock part 145 is a bar-shaped member extending in the leftward direction 56 and rightward direction 55. For example, the lock part 145 is a columnar member formed of metal. The lock part 145 has both ends in the leftward and rightward directions 56, 55 that are respectively fixed to walls defining both ends of the case 101 in the leftward and rightward directions 56, 55.

The lock part 145 functions to keep the ink cartridge 30 mounted in the cartridge-receiving section 110 in a mounted position shown in FIG. 1. The ink cartridge 30 having been inserted in the cartridge-receiving section 110 is engaged with the lock part 145. The ink cartridge 30 is thus retained in the cartridge-receiving section 110.

<Contact Unit 160>

As shown in FIG. 1, the contact unit 160 is disposed on the top wall 115 of the case 101. The contact unit 160 is arranged at such a position that at least a portion of the contact unit 160 is disposed above a board support part 130 and an IC board 64 (described later) of the ink cartridge 30 that has been received in the cartridge-receiving section 110. That is, when the ink cartridge 30 has been received in the cartridge-receiving section 110, at least a portion of the contact unit 160 can face the board support part 130 and the IC board 64 of the mounted ink cartridge 30.

The contact unit 160 has a lower surface on which four contacts (not shown) are formed. These four contacts are arranged to be aligned with one another in the rightward direction 55 and leftward direction 56 to correspond to four electrodes 65 (see FIG. 3) mounted on an upper surface of the IC board 64 of the ink cartridge 30. Numbers of the contacts and the electrodes 65 are not limited to four, but may be arbitrary.

Each contact on the contact unit 160 is electrically connected to a controller 1 (see FIG. 1) via electrical circuits. The controller 1 is provided in the printer 10. In other words, the controller 1 is disposed outside of the ink cartridge 30. The controller 1 may include a CPU, a ROM and a RAM and the like. Electrical connection between the contacts and corresponding electrodes 65 can apply a voltage to the electrode 65, provide grounding of the electrode 65, and supply power to the electrode 65. Also, when the contacts and corresponding electrodes 65 are electrically connected, the controller 1 is accessible to data stored in the IC board 64 of the ink cartridge 30 through the contact unit 160. Outputs from the electrical circuits are configured to be inputted to the controller 1.

Further, although not shown in the drawings, two protrusions are provided on the lower surface of the contact unit 160. These protrusions protrude downward in the downward direction 53 from the lower surface of the contact unit 160. One of the two protrusions are positioned rightward of the four contacts, while remaining one of the two protrusions are positioned leftward of the four contacts.

<Protrusion 125>

As shown in FIG. 2, in the cartridge-receiving section 110, the protrusion 125 is disposed on the end wall 117 at a position above the corresponding ink needle 102. The protrusion 125 protrudes in the removing direction 52 from the end wall 117 of the case 101. The protrusion 125 has a generally rectangular cross-sectional shape taken along a plane orthogonal to the removing direction 52, with an upper-right corner of the rectangular chamfered, and an uppermost portion of the rectangular provided with a rib extending upward therefrom.

When the ink cartridge 30 has been mounted in the cartridge-receiving section 110, i.e., when the ink cartridge 30 is in its operational state, the protrusion 125 is inserted into a space 95 (more specifically, space 95A; see FIG. 3) formed below the IC board 64 of the ink cartridge 30.

<Ink Cartridge 30>

Figure 5:
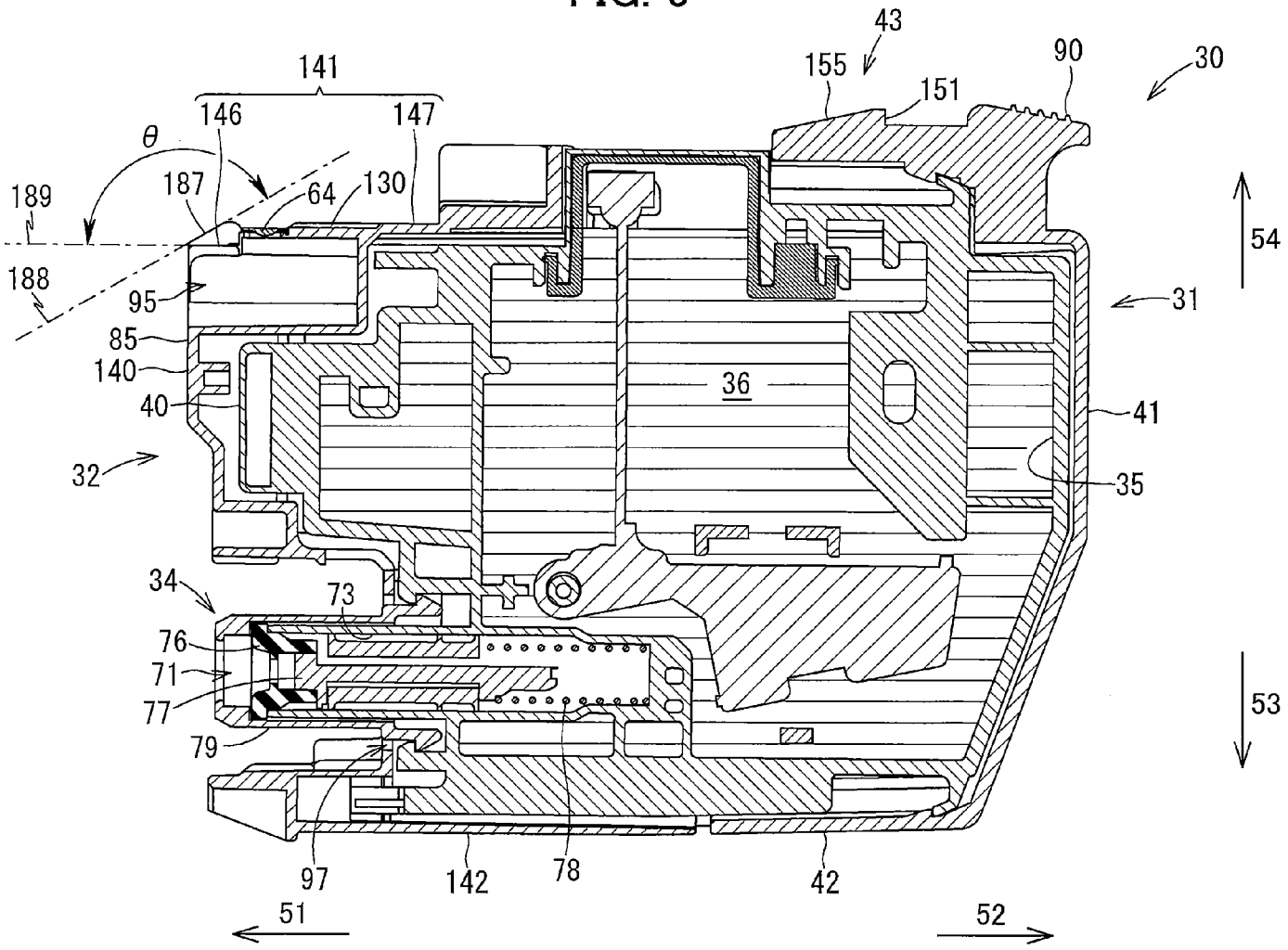
FIG. 5 is a vertical cross-sectional view showing an internal structure of the ink cartridge according to the embodiment.

The ink cartridge 30 is a container configured to store ink therein. As shown in FIGS. 1 and 5, the ink cartridge 30 has an internal space serving as the ink chamber 36 for storing ink. The ink cartridge 30 includes a front cover 32, a rear cover 31 and an internal frame 35. The front cover 32 and rear cover 31 constitutes a contour (external shape) of the ink cartridge 30. The internal frame 35 is accommodated in the front cover 32 and rear cover 31. The ink chamber 36 is formed in the internal frame 35 in the present embodiment, but may be formed by the front cover 32 and rear cover 31. The rear cover 31 and front cover 32 are an example of a cartridge body.

Figure 3:
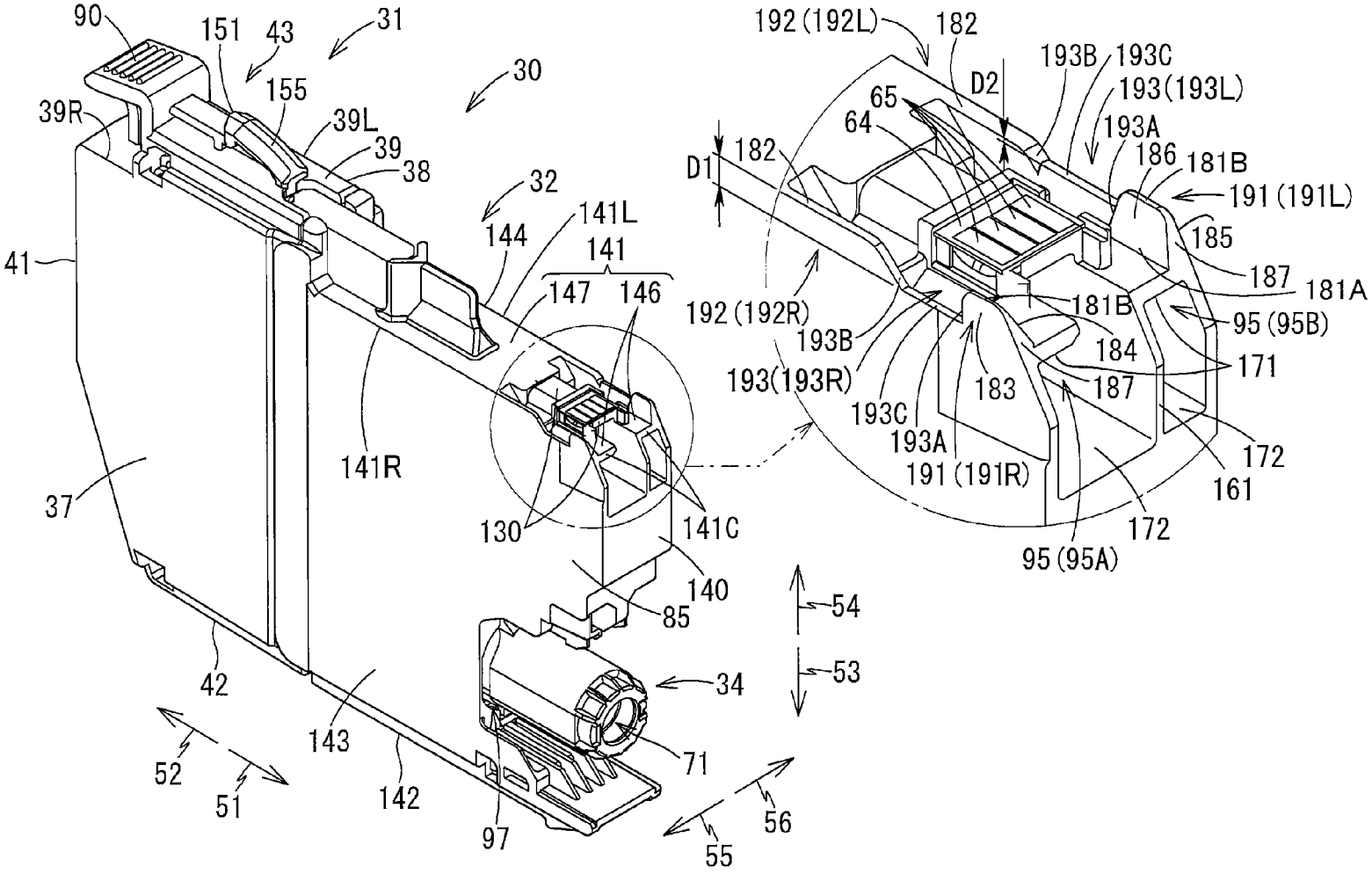
FIG. 3 is a perspective view showing an external appearance of the ink cartridge according to the embodiment.

The state of the ink cartridge 30 shown in FIGS. 1, 3 and 5 is a state in which the ink cartridge 30 is in the operational state. The ink cartridge 30 includes a front wall 140, a rear wall 41, upper walls 39 and 141, bottom walls 42 and 142, right side walls 37 and 143, and left side walls 38 and 144, as will be described later. In the operational state, the ink cartridge 30 is in an orientation such that: a direction from the rear wall 41 toward the front wall 140 is coincident with the mounting direction 51; a direction from the front wall 140 toward the rear wall 41 is coincident with the removing direction 52; a direction from the upper walls 39, 141 toward the bottom walls 42, 142 is coincident with the downward direction 53; and a direction from the bottom walls 42, 142 toward the upper walls 39, 141 is coincident with the upward direction 54. Also, when the ink cartridge 30 is being inserted in the cartridge-receiving section 110, the front wall 140 faces in the mounting direction 51; the rear wall 41 faces in the removing direction 52; the right side walls 37 and 143 face in the rightward direction 55; the left side walls 38 and 144 face in the leftward direction 56; the bottom walls 42 and 142 face in the downward direction 53; and the upper walls 39 and 141 face in the upward direction 54.

As shown in FIGS. 3 and 5, the ink cartridge 30 includes the front cover 32 including the front wall 140, the rear cover 31 having a generally rectangular parallelepiped shape, and the internal frame 35 defining the ink chamber 36. The rear cover 31 and front cover 32 are attached to the internal frame 35 to constitute the outer shape (contour) of the ink cartridge 30. The internal frame 35 is accommodated within the rear cover 31 and front cover 32. The ink cartridge 30 has a generally flat shape having a height in the downward direction 53 and upward direction 54, a width in the rightward direction 55 and leftward direction 56, and a length in the mounting direction 51 and removing direction 52, the width being smaller than the height and the length. The front wall 140 of the front cover 32 faces in the mounting direction 51 when the ink cartridge 30 is inserted into the cartridge-receiving section 110. The rear cover 31 includes the rear wall 41 that faces in the removing direction 52 when the ink cartridge 30 is inserted into the cartridge-receiving section 110. That is, the rear wall 41 and the front wall 140 are arranged to interpose the ink chamber 36 therebetween.

<Rear Cover 31>

As shown in FIGS. 3 and 5, the rear cover 31 is generally box-shaped having an aperture facing in the mounting direction 51. Specifically, the rear cover 31 includes: the rear wall 41; the right side wall 37 and left side wall 38 arranged to be separated from each other in the rightward direction 55 and leftward direction 56; the upper wall 39 facing in the upward direction 54; and the bottom wall 42 facing in the downward direction 53. The right side wall 37, left side wall 38, upper wall 39 and the bottom wall 42 extend from the rear wall 41 in the mounting direction 51 to define the aperture facing in the mounting direction 51. The internal frame 35 is inserted in the rear cover 31 through this aperture. That is, the rear cover 31 covers a rear portion of the internal frame 35. In a state where the internal frame 35 has been inserted in the rear cover 31, the ink chamber 36 is arranged between the bottom wall 42 and the upper wall 39.

The upper wall 39 has a right edge 39R and a left edge 39L (see FIG. 3). That is, the right edge 39R is an end of the upper wall 39 in the rightward direction 55, while the left edge 39L is an end of the upper wall 39 in the leftward direction 56. The right side wall 37 extends in the downward direction 53 from the right edge 39R, whereas the left side wall 38 extends in the downward direction 53 from the left edge 39L.

On the upper wall 39 of the rear cover 31, a projection 43 is formed. The projection 43 extends in the mounting direction 51 and removing direction 52, and is formed at a center on the upper wall 39 in the rightward direction 55 and leftward direction 56. The projection 43 has a surface facing in the removing direction 52, which serves as a lock surface 151. That is, the lock surface 151 extends in the downward direction 53 and the upward direction 54. When the ink cartridge 30 has been mounted in the cartridge-receiving section 110, the lock surface 151 facing in the removing direction 52 can make contact with the lock part 145 of the cartridge-receiving section 110 (see FIG. 1). This contact of the lock surface 151 against the lock part 145 can keep the ink cartridge 30 mounted in the cartridge-receiving section 110 against an urging force of a coil spring 78 (described later) of the ink cartridge 30.

The projection 43 includes a sloped surface 155 positioned further in the mounting direction 51 (i.e., frontward) relative to the lock surface 151. The sloped surface 155 is a surface facing in the upward direction 54 and in the mounting direction 51. That is, the sloped surface 155 is sloped downward toward a front end of the projection 43 in the mounting direction 51 (i.e., downstream in the mounting direction 51).

On the upper wall 39 of the rear cover 31, an operation part 90 is also provided. The operation part 90 is provided further in the removing direction 52 (rearward) relative to the lock surface 151, i.e., the operation part 90 is positioned downstream of the lock surface 151 in the removing direction 52. The operation part 90 is subject to user's operation for removing the ink cartridge 30 mounted in the cartridge-receiving section 110 therefrom.

<Front Cover 32>

Figure 4:
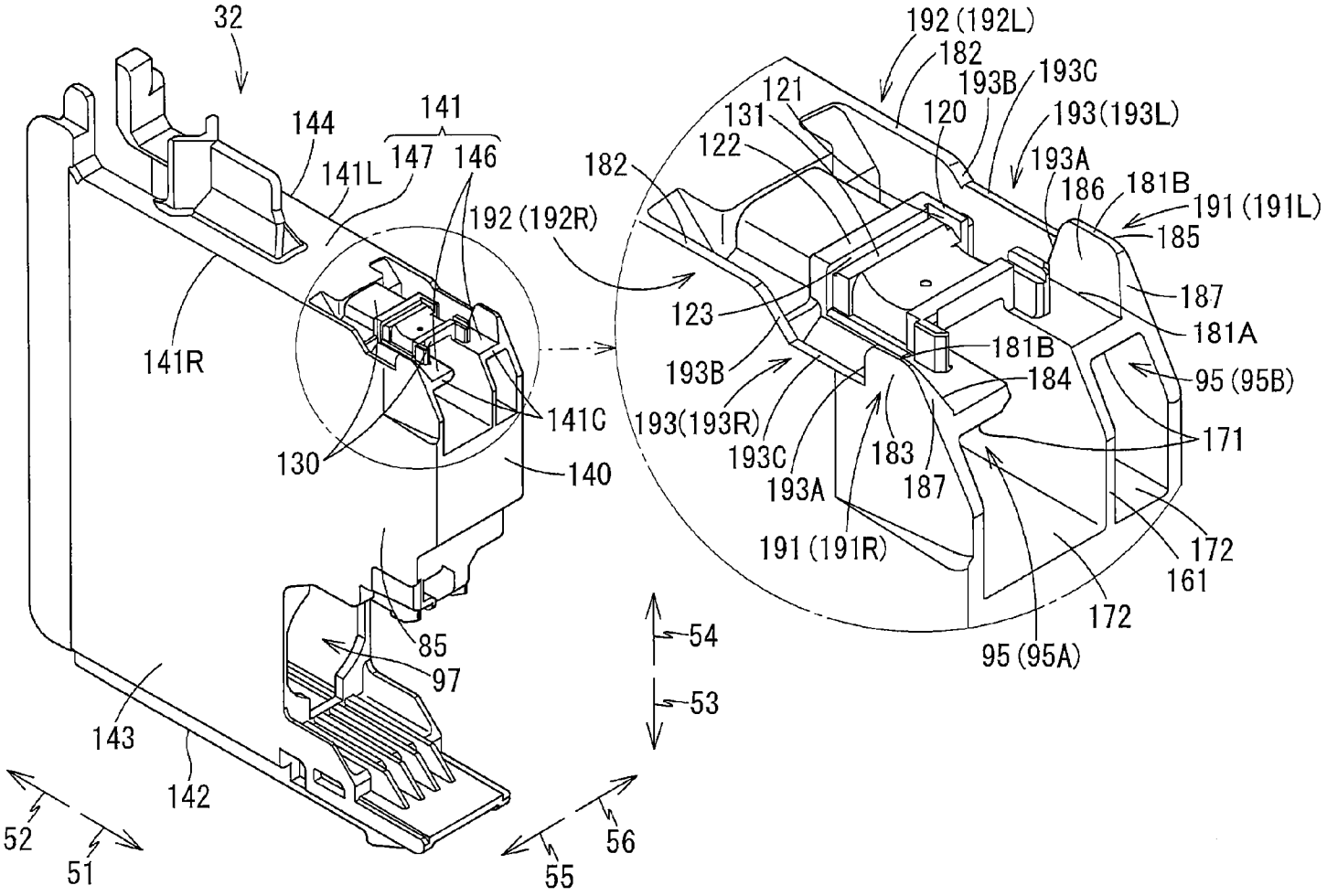
FIG. 4 is a perspective view showing an external appearance of a front cover 32 constituting the ink cartridge according to the embodiment.

The front cover 32 is generally box-shaped having an aperture facing in the removing direction 52, as shown in FIGS. 3 to 5. Specifically, the front cover 32 includes: the front wall 140; the right side wall 143 and left side wall 144 arranged to be separated from each other in the rightward direction 55 and leftward direction 56; and the upper wall 141 and the lower wall 142 arranged to be separated from each other in the downward direction 53 and upward direction 54. The right and left side walls 143 and 144, upper wall 141 and lower wall 142 extend in the removing direction 52 from the front wall 140 to define the aperture facing in the removing direction 52. The internal frame 35 is inserted into the front cover 32 through this aperture. That is, the front cover 32 covers a front portion of the internal frame 35 which is not covered by the rear cover 31.

The upper wall 141 includes a first upper wall 146 and a second upper wall 147. The first upper wall 146 constitutes a front portion of the upper wall 141, while the second upper wall 147 constitutes a rear portion of the upper wall 141. The first upper wall 146 is positioned lower than the second upper wall 147.

Specifically, the first upper wall 146 is configured of a pair of left and right wall parts arranged to be spaced apart from each other in the rightward direction 55 and leftward direction 56.

Specifically, the upper wall 141 has a right edge 141R in the rightward direction 55 and a left edge 141L in the leftward direction 56. That is, the right edge 141R constitutes right edges of the first upper wall 146 and second upper wall 147. The left edge 141L constitutes left edges of the first upper wall 146 and second upper wall 147. The right side wall 143 extends in the downward direction 53 from the right edge 141R of the upper wall 141, whereas the left side wall 144 extends in the downward direction 53 from the left edge 141L of the upper wall 141. The right edge 141R and the right edge 39R are an example of a second end, and the left edge 141L and the left edge 39L are an example of a first end. Alternatively, the right edge 141R and right edge 39R may be a first end, and the left edge 141L and left edge 39L maybe a second end, in case that the leftward direction 56 corresponds to the third direction and the rightward direction 55 corresponds to the second direction.

The front wall 140 of the front cover 32 has an upper end portion that is recessed in the removing direction 52 below the first upper wall 146 to form the space 95. This space 95 can receive the corresponding protrusion 125 therein when the ink cartridge 30 has been mounted in the cartridge-receiving section 110. Hence, when the front cover 32 is viewed in the removing direction 52, surfaces defining the space 95 have a shape in conformance with the outer shape of the protrusion 125 when the ink cartridge 30 is viewed in the removing direction 52.

As shown in FIG. 4, a through-hole 97 is formed in a lower portion of the front wall 140 of the front cover 32 to penetrate the same in the removing direction 52. When the internal frame 35 has been inserted in the front cover 32, the ink supply part 34 of the internal frame 35 is exposed to outside through the through-hole 97. Thus, the through-hole 97 has a shape and dimension corresponding to those of the ink supply part 34 of the internal frame 35. The through-hole 97 is formed at a position corresponding to the location of the ink supply part 34.

Further, a protruding part 85 is also formed on the front wall 140 of the front cover 32. Specifically, the protruding part 85 is disposed on an upper portion of the front wall 140 to protrude in the mounting direction 51 therefrom. The protruding part 85 has a protruding end face constituting a portion of the front wall 140. The space 95 is formed on this protruding end face of the protruding part 85 to be recessed in the removing direction 52 therefrom. In other words, the space 95 is open in the mounting direction 51 toward exterior of the ink cartridge 30.

As described above, the contour of the ink cartridge 30 is defined by the following six walls: the front wall 140, rear wall 41, upper walls 39 and 141, bottom walls 42 and 142, right side walls 37 and 143, and left side walls 38 and 144. More specifically, the contour (external shape) of the ink cartridge 30 is defined by the following six outer surfaces: a front surface of the front wall 140, a rear surface of the rear wall 41, upper surfaces of the upper walls 39 and 141, bottom surfaces of the bottom walls 42 and 142, right surfaces of the right side walls 37 and 143, and left surfaces of the left side walls 38 and 144. Of these six outer surfaces, the right surfaces of the right side walls 37 and 143, and the left surfaces of the left side walls 38 and 144 have the largest area. The front surface of the front wall 140 and rear surface of the rear wall 41 are surfaces extending in the upward direction 54, downward direction 53, rightward direction 55 and leftward direction 56. The upper surfaces of the upper walls 39 and 141 and the bottom surfaces of the bottom walls 42 and 142 are surfaces extending in the mounting direction 51, removing direction 52, rightward direction 55 and leftward direction 56. The right surfaces of the right side walls 37, 143 and the left surfaces of the left side walls 38 and 144 are surfaces extending in the mounting direction 51, removing direction 52, upward direction 54 and downward direction 53.

The upper surfaces of the upper walls 39 and 141 are an example of a first surface and an example of an upper surface, and the upper walls 39 and 141 are an example of a first wall and an example of an upper wall. The front surface of the front wall 140 is an example of a front surface, while the rear surface of the rear wall 41 is an example of a rear surface. The left surfaces of the left side walls 38 and 144 are an example of a second surface and an example of a first side surface. Alternatively, the right surfaces of the right side walls 37 and 143 may also be an example of the second surface and an example of a second side surface, in case that the leftward direction 56 corresponds to the third direction and the rightward direction 55 corresponds to the second direction.

<Internal Frame 35>

Although not shown in the drawings, the internal frame 35 has a generally annular shape whose pair of surfaces opposing in the rightward direction 55 and leftward direction 56 are respectively open. These open surfaces are sealed by films (not shown), respectively, thereby forming the ink chamber 36 in the internal frame 35 for storing ink. Specifically, the internal frame 35 has a front wall 40 that can oppose a rear surface of the front wall 140 of the front cover 32 when the internal frame 35 has been inserted in the front cover 32. That is, the front wall 40 defines a portion of the ink chamber 36. The ink supply part 34 is disposed on the front wall 40 of the internal frame 35.

<Ink Supply Part 34>

As shown in FIG. 5, the ink supply part 34 is disposed on a lower portion of the front wall 40 of the internal frame 35 and protrudes in the mounting direction 51 from the front wall 140 of the front cover 32. Specifically, the ink supply part 34 has a cylindrical shape as its external appearance, and is arranged to protrude in the mounting direction 51 out of the front cover 32 through the hole 97 formed in the front wall 140. The ink supply part 34 includes a cylindrical wall 73 having a circular cylindrical shape, a sealing member 76 and a cap 79.

The cylindrical wall 73 extends to connect inside the ink chamber 36 and the exterior of the ink cartridge 30. Specifically, the cylindrical wall 73 has an end in the removing direction 52 (rear end) that is in communication with the ink chamber 36. The cylindrical wall 73 has one end in the mounting direction 51 (front end) that is in communication with the exterior of the ink cartridge 30. The cylindrical wall 73 defines an internal space therein. Thus, the cylindrical wall 73 can provide communication between the ink chamber 36 and exterior of the ink cartridge 30 via the internal space of the cylindrical wall 73. In other words, the ink supply part 34 can serve to allow ink in the ink chamber 36 to flow out of the ink cartridge 30 via the internal space of the cylindrical wall 73.

The sealing member 76 and cap 79 are attached to the end of the cylindrical wall 73 in the mounting direction 51. The sealing member 76 is formed with the ink supply port 71 that penetrates a center portion of the sealing member 76 in the mounting direction 51 and removing direction 52.

Within the internal space of the cylindrical wall 73, a valve 77 and the coil spring 78 are disposed. The valve 77 and coil spring 78 function to selectively switch states of the ink supply part 34 between an open state where ink can flow out of the ink chamber 36 to the exterior of the ink cartridge 30 via the internal space of the cylindrical wall 73, and a closed state where the ink is prevented from flowing out of the ink cartridge 30 from the internal space of the cylindrical wall 73.

Specifically, the valve 77 can move in the mounting direction 51 and removing direction 52 to open and close the ink supply port 71 formed in the sealing member 76. The coil spring 78 urges the valve 77 in the mounting direction 51. With this structure, the valve 77 can close the ink supply port 71 when no external force is applied to the valve 77.

The sealing member 76 is disposed on the front end (tip end) of the cylindrical wall 73 (the end of the cylindrical wall 73 in the mounting direction 51). The sealing member 76 is a disk-shaped member formed of an elastic material such as rubber and elastomer. The ink supply port 71 is a through-hole penetrating the center portion of the sealing member 76 in the mounting direction 51 and removing direction 52. More specifically, the center portion of the sealing member 76 has a peripheral surface having a circular shape in a front view. This peripheral surface defines the ink supply port 71. The ink supply port 71 has an inner diameter slightly smaller than an outer diameter of the ink needle 102. The cap 79 is externally fitted onto the cylindrical wall 73 to form a liquid-tight seal between the sealing member 76 and the tip end of the cylindrical wall 73. The cap 79 is formed with an opening to expose the ink supply port 71 to the outside of the ink cartridge 30 (see FIG. 5).

When the ink cartridge 30 is inserted into the cartridge-receiving section 110 with the valve 77 closing the ink supply port 71, the ink needle 102 enters into the ink supply port 71.

The ink needle 102 elastically deforms the sealing member 76, while an outer surface of the ink needle 102 makes close contact with the peripheral surface defining the ink supply port 71 to form a light-tight seal therebetween. When the tip end of the ink needle 102 passes through the sealing member 76 and enters into the internal space of the cylindrical wall 73, the tip end of the ink needle 102 makes contact with the valve 77. As the ink cartridge 30 is inserted further in mounting direction 51 into the cartridge-receiving section 110, the ink needle 102 moves the valve 77 in the removing direction 52 against the urging force of the coil spring 78.

Accordingly, the ink can flow out of the ink chamber 36 into the ink needle 102 through the internal space of the cylindrical wall 73 in the ink supply part 34. Although not shown in the drawings, the ink can flow from the internal space of the cylindrical wall 73 into the internal space of the ink needle 102 through through-holes (not shown) formed in the tip end of the ink needle 102. That is, the ink in the ink chamber 36 can flow out of the ink cartridge 30 through the internal space of the cylindrical wall 73, the ink supply port 71, and the ink needle 102.

Incidentally, in the ink supply part 34, the valve 77 for closing the ink supply port 71 may not necessarily be provided. For example, the ink supply port 71 may be closed by a film and the like, instead of the valve 77. In this case, the ink needle 102 may break through the film at the time of insertion of the ink cartridge 30 into the cartridge-receiving section 110, thereby opening the ink supply port 71 to allow the tip end of the ink needle 102 to enter into the internal space of the cylindrical wall 73 through the ink supply port 71. Still alternatively, the ink supply port 71 may be normally closed by elasticity of the sealing member 76 itself. In this case, the ink supply port 71 can be opened only by insertion of the ink needle 102 into the ink supply port 71. Specifically, the inserted ink needle 102 pushes the ink supply port 71 radially outward to enlarge the diameter of the ink supply port 71, thereby opening the ink supply port 71.

While the ink supply part 34 protrudes in the mounting direction 51 from the front wall 140 of the ink cartridge 30 in the present embodiment, the ink supply part 34 may not necessarily protrude from the front wall 140, provided that the ink in the ink chamber 36 can flow out of the ink cartridge 30 through an opening formed in the front wall 140.

<Board Support Part 130 and IC Board 64>

As shown in FIG. 3, the board support part 130 is formed on the first upper wall 146 of the front cover 32. The board support part 130 has a right end portion supported by the right wall part constituting the first upper wall 146, and a left end portion supported by the left wall part constituting the first upper wall 146. That is, the board support part 130 is arranged to extend across the left and right wall parts of the first upper wall 146. The board support part 130 defines an upper boundary edge of the space 95. The board support part 130 has an end in the removing direction 52 (rear end) that is connected to the second upper wall 147 of the front cover 32.

The board support part 130 has an upper surface 131 (shown in FIG. 4) to which the IC board 64 is attached by a well-known method such as adhesive bonding. That is, the board support part 130 supports the IC board 64. Put another way, the IC board 64 is arranged on the first upper wall 146 through the board support part 130. Note that the IC board 64 may be directly attached to the first upper wall 146 without interposition of the board support part 130.

As shown in FIG. 4, the board support part 130 includes a projection 120 formed adjacent to and on the left side of the upper surface 131. The projection 120 protrudes in the upward direction 54 relative to the upper surface 131, and extends in the mounting direction 51 and removing direction 52. The projection 120 has a right surface 121 that faces in the rightward direction 55. That is, the right surface 121 is a surface extending in the in upward direction 54, downward direction 53, mounting direction 51 and the removing direction 52. The right surface 121 is an example of a positioning surface.

The board support part 130 also includes a projection 122 formed adjacent to and on the rear side of the upper surface 131. The projection 122 protrudes in the upward direction 54 relative to the upper surface 131. The projection 122 extends in the rightward direction 55 and leftward direction 56. The projection 122 has a front surface 123 facing in the mounting direction 51. That is, the front surface 123 is a surface extending in the upward direction 54, downward direction 53, rightward direction 55 and leftward direction 56.

The IC board 64 (an example of an accessed part) is a substrate (circuit substrate) and is supported on the board support part 130 such that: a left end face of the IC board 64 (end face in the leftward direction 56) is in contact with the right surface 121 of the projection 120; and a rear end face of the IC board 64 (end face in the removing direction 52) is in contact with the front surface 123 of the projection 122. With this structure, the IC board 64 is fixed in position relative to the board support part 130 in the rightward direction 55 and leftward direction 56 by the right surface 121 of the projection 120, as well as in the mounting direction 51 and removing direction 52 by the front surface 123 of the projection 122.

In the present embodiment, the IC board 64 is inserted from the right of the board support part 130 (i.e., inserted in the leftward direction 56) and is fixed onto the upper surface 131. For attaching the IC board 64 to the upper surface 131 from the right, the IC board 64 is slid from the right side of the board support part 130 in the leftward direction 56 through a recess 193 formed in a second protrusion 192R described later, and is then placed over the upper surface 131 of the board support part 130. As the IC board 64 is further slid in the leftward direction 56, the left end face of the IC board 64 is brought into contact with the right surface 121 of the projection 120. The IC board 64 is thus mounted on the board support part 130.

Note that the IC board 64 may be fixed to the upper surface 131 from above (in the downward direction 53), not from the right (in the leftward direction 56).

As shown in FIG. 3, the IC board 64 has the upper surface (i.e., a surface facing in the upward direction 54) on which the four electrodes 65 are disposed. The electrodes 65 extend in the mounting direction 51 and removing direction 52, and are arranged, on the upper surface of the IC board 64, to be separated from one another in the rightward direction 55 and leftward direction 56. The electrodes 65 may be a clock electrode, a data electrode, an electrode for receiving power, and an electrode for grounding, for example. On the IC board 64, an IC (not shown) is also mounted so as to be electrically connected to each of the electrodes 65. The IC is a semiconductor integrated circuit, and stores data indicative of: information of the ink cartridge 30 (a lot number and a manufactured date, for example); and information on the ink stored in the ink cartridge 30, such as the color of the ink, for example. The upper surface of the IC board 64 is an example of a mount surface and an example of an accessed surface. The electrodes 65 are an example of an electrical interface.

The four electrodes 65 can be electrically connected to the four contacts formed in the contact unit 160 of the cartridge-receiving section 110, when the ink cartridge 30 has been mounted in the cartridge-receiving section 110. In other words, the IC board 64 can be electrically connected to the controller 1 via the electrodes 65, the contact unit 160, and the electrical circuits connecting between the contact unit 160 and the controller 1. The controller 1 can retrieve the data stored in the IC when the electrical connection is established.

<First Protrusion 191>

As shown in FIG. 3, a pair of first protrusions 191 is formed on the first upper wall 146 of the upper wall 141 of the front cover 32. Specifically, the pair of first protrusions 191 is provided on a front end portion 141C (one end portion in the mounting direction 51) of the first upper wall 146. The front end portion 141C is an example of a third end. The first protrusions 191 protrude in the upward direction 54 from the first upper wall 146. That is, the first protrusions 191 have base ends 181A connected to the first upper wall 146, and protruding ends 181B in the upward direction 54 that are positioned further upward in the upward direction 54 relative to the IC board 64. That is, the first protrusions 191 protrude higher in the upward direction 54 than the IC board 64. The first protrusions 191 extend in the mounting direction 51 and removing direction 52. The base ends 181A are an example of a base end. The protruding ends 181B are an example of a first protruding end and a protruding end.

The first protrusions 191 are positioned further in the mounting direction 51 (frontward) relative to the IC board 64 in the present embodiment. However, the first protrusions 191 may not be arranged on the front end portion 141C of the first upper wall 146. For example, the first protrusions 191 may be formed to oppose the IC board 64 in the rightward direction 55 and leftward direction 56, or to be positioned further in the removing direction 52 (rearward) relative to the IC board 64. Alternatively, the first protrusions 191 may be formed at positions more downstream in the mounting direction 51 (frontward) relative to the circuit substrate 64 so as to partially overlap with the IC board 64 in the rightward direction 55 and leftward direction 56.

Specifically, in the present embodiment, the pair of first protrusions 191 are configured of a first protrusion 191R and a first protrusion 191L. However, a single first protrusion 191 or not less than three first protrusions 191 may be provided, instead of two first protrusions 191.

The first protrusion 191R is disposed further in the rightward direction 55 (rightward) relative to the IC board 64. Specifically, the first protrusion 191R is arranged on the right wall part of the first upper wall 146. Put another way, the first protrusion 191R defines a portion of the right end of the first upper wall 146. That is, the first protrusion 191R is positioned closer to the right edge 141R of the upper wall 141 than the IC board 64 is to the right edge 141R.

Likewise, the first protrusion 191L is disposed further in the leftward direction 56 (leftward) relative to the IC board 64. Specifically, the first protrusion 191L is arranged on the left wall part of the first upper wall 146. Put another way, the first protrusion 191L defines a portion of the left end of the first upper wall 146. That is, the first protrusion 191L is positioned closer to the left edge 141L of the upper wall 141 than the IC board 64 is to the left edge 141L.

Accordingly, the first protrusions 191 includes the first protrusion 191R disposed further in the rightward direction 55 relative to the IC board 64, and the first protrusion 191L disposed further in the leftward direction 56 relative to the IC board 64. Even in case that not less than three first protrusions 191 are provided, it is preferable that the first protrusions 191 include one first protrusion 191 disposed further in the rightward direction 55 relative to the IC board 64, and another first protrusion 191 disposed further in the leftward direction 56 relative to the IC board 64.

Figure 6:
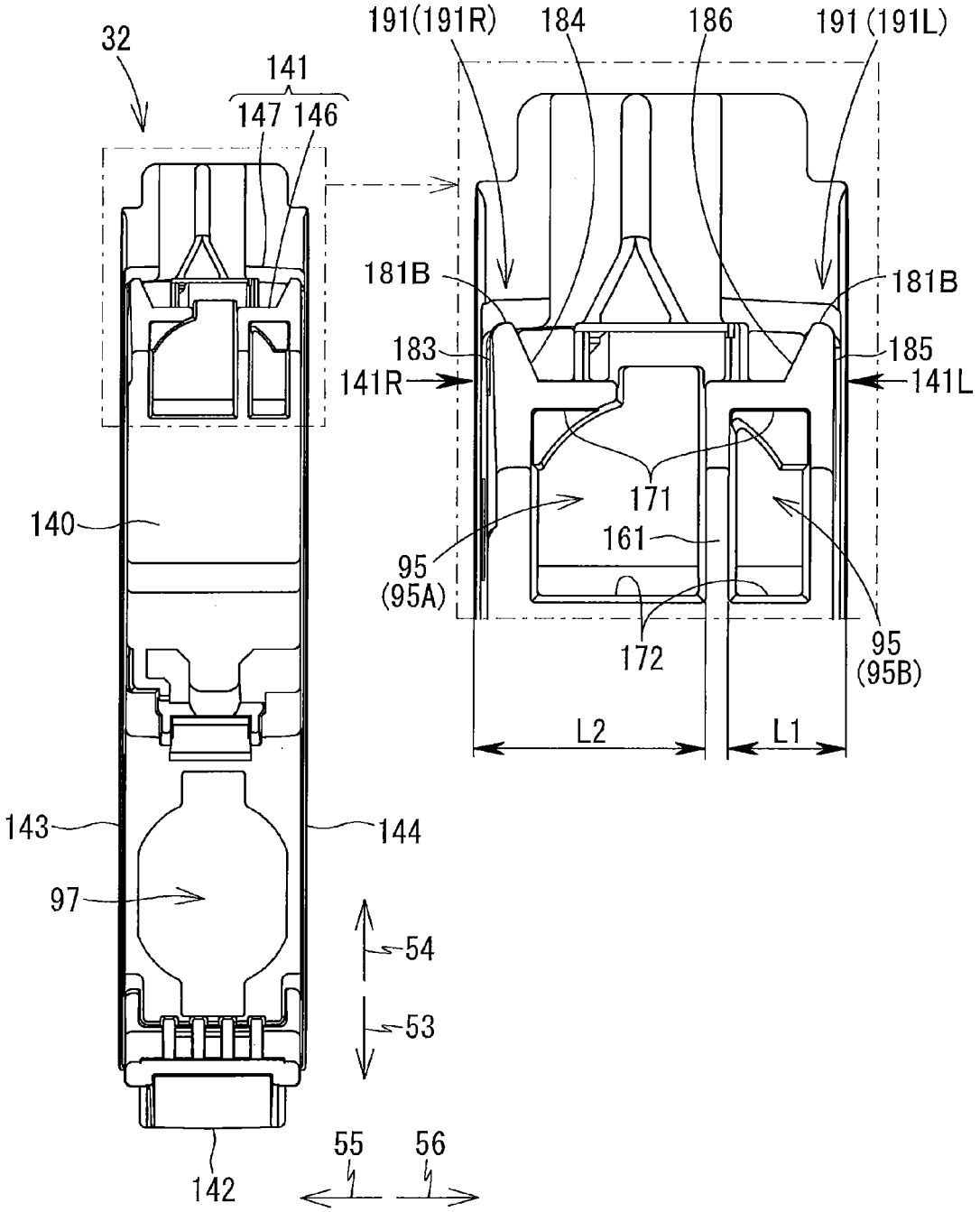
FIG. 6 is a front view of the front cover 32 constituting the ink cartridge according to the embodiment.

As shown in FIG. 6, each of the first protrusions 191 is tapered toward its protruding end 181B from its base end 181A when viewed in the removing direction 52 (i.e., in a front view). Specifically, each first protrusion 191 is tapered from the base end 181A toward the protruding end 181B such that a distance between the protruding end 181B and the IC board 64 in the rightward direction 55 and leftward direction 56 is longer than a distance between the base end 181A and the IC board 64 in the second direction.

More specifically, the first protrusion 191R includes a first surface 183 and a second surface 184.

The first surface 183 faces in the rightward direction 55 which is a direction opposite the leftward direction 56 toward the IC board 64, when the first protrusion 191R is viewed in the removing direction 52 (in a front side view). The first surface 183 is a surface extending in the mounting direction 51, removing direction 52, upward direction 54 and downward direction 53. That is, the first surface 183 is a surface orthogonal to the upper wall 141.

The second surface 184 is a sloped surface facing in the leftward direction 56 which is a direction toward the IC board 64, when the first protrusion 191R is viewed in the removing direction 52 (in a front side view). The second surface 184 is sloped to extend upward in the upward direction 54 toward the right in the leftward direction 56 when the first protrusion 191R is viewed in the removing direction 52 (in a front side view). That is, the second surface 184 extends in the mounting direction 51 and removing direction 52 and in a direction going further in the upward direction 54 as approaching toward the right edge 141R in the rightward direction 55.

Put another way, the second surface 184 is a surface extending away from the IC board 64 toward the protruding end 181B from the base end 181A of the first protrusion 191R. More specifically, the base end of the second surface 184 is positioned closer to the right end of the first upper wall 146 than the IC board 64 is to the right end of the first upper wall 146. With this structure, the first protrusion 191R as a whole is disposed further in the rightward direction 55

(rightward) relative to the IC board 64 so as to be spaced apart from the circuit substrate 64.

The first protrusion 191L includes a first surface 185 and a second surface 186.

The first surface 185 faces in the leftward direction 56 which is a direction opposite the rightward direction 55 toward the IC board 64, when the first protrusion 191L is viewed in the removing direction 52 (in a front side view). The first surface 185 is a surface extending in the mounting direction 51, removing direction 52, upward direction 54 and downward direction 53. That is, the first surface 185 is a surface orthogonal to the upper wall 141.

The second surface 186 faces in the rightward direction 55 which is a direction toward the IC board 64 when the first protrusion 191L is viewed in the removing direction 52 (in a front side view). The second surface 186 is sloped to extend upward in the upward direction 54 toward the left in the leftward direction 56 when the first protrusion 191L is viewed in the removing direction 52 (in a front side view). That is, the second surface 186 is a surface extending in the mounting direction 51, removing direction 52 and in a direction going further in the upward direction 54 as approaching toward the left edge 141L in the leftward direction 56.

Put another way, the second surface 186 extends away from the IC board 64 from its base end 181A toward its protruding end 181B. More specifically, the base end of the second surface 186 is positioned closer to the left end of the first upper wall 146 than the IC board 64 is to the left end of the first upper wall 146. With this structure, the first protrusion 191L as a whole is disposed further in the leftward direction 56 (leftward) relative to the IC board 64 so as to be spaced apart from the IC board 64.

Incidentally, the first surfaces 183 and 185, and the second surfaces 184 and 186 do not necessarily face in the above described directions. For example, when the first protrusion 191R extends in the rightward direction 55 and leftward direction 56 and is positioned further in the mounting direction 51 relative to the IC board 64, the first surface 183 may face in the mounting direction 51 and the second surface 184 may face in the removing direction 52. Also, when the first protrusion 191L extends in the rightward direction 55 and leftward direction 56 and is positioned further in the removing direction 52 relative to the IC board 64, the first surface 185 may face in the removing direction 52 and the second surface 186 may face in the mounting direction 51.

Each protrusion 191 has an end face 187 in the mounting direction 51. The end face 187 is sloped to extend upward in the upward direction 54 toward the rear in the removing direction 52. In other words, the end face 187 is a surface extending in the rightward direction 55, leftward direction 56 and in a direction going further in the upward direction 54 as approaching toward the IC board 64 in the removing direction 52. As shown in FIG. 5, assuming an imaginary plane 188 including the end face 187, the imaginary plane 188 forms an obtuse angle θ relative to another imaginary plane 189 including an upper surface of the first upper wall 146.

<Second Protrusion 192>

As shown in FIG. 3, a pair of second protrusions 192 is formed on the first upper wall 146 constituting the upper wall 141 of the front cover 32. The second protrusions 192 are positioned further in the removing direction 52 (i.e., rearward) relative to the first protrusions 191. Note that the second protrusions 192 may be arranged further in the mounting direction 51 (frontward) relative to the first protrusions 191, depending on the positions of the first protrusions 191.

The second protrusions 192 protrude in the upward direction 54 from the first upper wall 146, and extend in the mounting direction 51 and removing direction 52.

Each second protrusion 192 has one end in the mounting direction 51 (front end) that is positioned further in the mounting direction 51 (frontward) relative to the IC board 64. The ends of the second protrusions 192 in the mounting direction 51 (front ends) are connected to the ends of the first protrusions 191 in the removing direction 52 (rear ends). However, the second protrusions 192 may not be connected to the first protrusions 191.

Each second protrusion 192 has one end in the removing direction 52 (rear end) that is positioned further in the removing direction 52 (rearward) relative to the IC board 64.

The ends of the second protrusions 192 in the mounting direction 51 (front ends of the second protrusions 192) may be arranged to be aligned with the end of the IC board 64 in the mounting direction 51 (front end of the IC board 64). Likewise, the ends of the second protrusions 192 in the removing direction 52 (rear ends of the second protrusions 192) may be arranged to be aligned with the end of the IC board 64 in the removing direction 52 (rear end of the IC board 64). That is, the second protrusions 192 may extend in the mounting direction 51 to have a portion aligned with the IC board 64 in the rightward direction 55 and leftward direction 56.

Specifically, the pair of second protrusions 192 is configured of a second protrusion 192R and a second protrusion 192L.

The second protrusion 192R is disposed further in the rightward direction 55 (rightward) relative to the IC board 64. More specifically, the second protrusion 192R is positioned on the right end of the first upper wall 146. The second protrusion 192L is disposed further in the leftward direction 56 (leftward) relative to the IC board 64. Specifically, the second protrusion 192L is positioned on the left end of the first upper wall 146.

In other words, the second protrusions 192 includes the second protrusion 192R positioned further in the rightward direction 55 relative to the IC board 64, and the second protrusion 192L positioned further in the leftward direction 56 relative to the IC board 64. Incidentally, in case that three or more than three second protrusions 192 are provided, it is preferable that the second protrusions 192 include one second protrusion 192 positioned further in the rightward direction 55 relative to the IC board 64, and another second protrusion 192 positioned further in the leftward direction 56 relative to the IC board 64.

Each second protrusion 192 is formed with the recess 193. The recess 193 is recessed in the downward direction 53 from a protruding end (upper end) 182 of the second protrusion 192. This protruding end 182 is an example of a second protruding end. The recess 193 is formed to be aligned with the IC board 64 in the rightward direction 55 and leftward direction 56. Specifically, the recess 193 has one end in the mounting direction 51 that is positioned slightly further in the mounting direction 51 (slightly frontward) relative to the end of the IC board 64 in the mounting direction 51 (front end of the IC board 64). The recess 193 has another end in the removing direction 52 that is positioned slightly further in the removing direction 52 (slightly rearward) relative to the end of the IC board 64 in the removing direction 52 (rear end of the IC board 64).

Incidentally, the recess 193 may be formed at a position other than the position shown in FIG. 3. For example, the recess 193 may be formed such that: the end of the recess 193 in the mounting direction 51 (front end) is located further in the mounting direction 51 (more frontward) than its position shown in FIG. 3; and the end of the recess 193 in the removing direction 52 (rear end) is located further in the removing direction 52 (more rearward) than its position shown in FIG. 3.

Each of the recesses 193 is defined by a first side surface 193A, a second side surface 193B, and a bottom surface 193C.

The first side surface 193A defines the end of the recess 193 in the mounting direction 51. The first side surface 193A is a surface extending in the rightward direction 55, leftward direction 56, upward direction 54 and the downward direction 53.

The second side surface 193B defines the end of the recess 193 in the removing direction 52. The second side surface 193B is sloped to extend upward in the upward direction 54 toward the rear in the removing direction 52. That is, the second side surface 193B is a surface extending in the rightward direction 55, leftward direction 56 and in a direction going further in the upward direction 54 as leaving away from the IC board 64 in the removing direction 52.

The bottom surface 193C is provided to connect the first side surface 193A and the second side surface 193B. Specifically, the bottom surface 193C has one end in the mounting direction 51 (front end) connected to a bottom edge of the first side surface 193A, and another end in the removing direction 52 (rear end) connected to a bottom edge of the second side surface 193B. The bottom surface 193C is a surface extending in the mounting direction 51, removing direction 52, rightward direction 55 and leftward direction 56.

Referring to FIG. 3, the recess 193 formed in the second protrusion 192R (i.e., recess 193R) has a depth D1 in the downward direction 53 that is deeper than a depth D2 in the downward direction 53 of the recess 193 formed in the second protrusion 192L (i.e., recess 193L). Accordingly, when attaching the IC board 64 to the upper surface 131 of the board support part 130, the IC board 64 can be slid, from the right side of the board support part 130 in the leftward direction 56, via the recess 193R having the deeper depth D1 to be located above the upper surface 131 of the board support part 130. The IC board 64 can be thus easily slid in the leftward direction 56.

If the projection 120 (see FIG. 4) of the board support part 130 is formed on the right end of the upper surface 131, instead of the left end of the upper surface 131, the recess 193L of the second protrusion 192L may be formed to have a depth in the downward direction 53 deeper than the depth D2 shown in FIG. 3. This is to allow the IC board 64 to be slid onto the board support part 130 from the left side thereof in the rightward direction 55 via the recess 193L having the deeper depth at the time of attaching the IC board 64 to the board support part 130.

<Rib 161>

As shown in FIGS. 3 and 4, a rib 161 is provided in the space 95 formed below the first upper wall 146. That is, the rib 161 is disposed below the first upper wall 146. Put another way, the rib 161 is arranged further in the downward direction 53 relative to the upper surface of the upper surface 141. Specifically, the rib 161 has an upper end connected to a back surface (lower surface) 171 of the first upper wall 146. The back surface 171 is a surface defining the upper boundary edge of the space 95. The rib 161 has a bottom end connected to a surface 172 defining a bottom boundary edge of the space 95. In other words, the rib 161 supports the first upper wall 146 from below. The rib 161 partitions the space 95 into two individual spaces 95A and 95B.

As shown in FIG. 6, the rib 161 and the left edge 141L of the upper wall 141 defines a distance L1 therebetween in the rightward direction 55 and leftward direction 56. Likewise, the rib 161 and the right edge 141R of the upper wall 141 define a distance L2 therebetween in the rightward direction 55 and leftward direction 56. In the present embodiment, the distance L1 is shorter than the distance L2.

<Operations for Mounting the Ink Cartridge 30 into the Cartridge-Receiving Section 110>

Hereinafter, operations for mounting the ink cartridge 30 into the cartridge-receiving section 110 will be described.

As shown in FIG. 5, in the ink cartridge 30 prior to be mounted in the cartridge-receiving section 110, the valve 77 closes the ink supply port 71. Hence, ink flow from the ink chamber 36 toward outside of the ink cartridge 30 is interrupted.

For mounting the ink cartridge 30, the ink cartridge 30 is inserted into the case 101 through the opening 112 of the cartridge-receiving section 110. A user inserts the ink cartridge 30 into the cartridge-receiving section 110 in the mounting direction 51 while pressing the rear wall 41 of the rear cover 31. At this time, a lower portion of the ink cartridge 30, that is, lower portions of the front cover 32 and rear cover 31, has been inserted and received in the corresponding lower guide groove 109.

As the ink cartridge 30 is further inserted into the cartridge-receiving section 110 in the mounting direction 51, the cap 79 (see FIG. 5) of the ink supply part 34 is being inserted into the guide part 105 of the corresponding ink needle 102, as shown in FIG. 1. Further, the space 95 (specifically, the space 95A) formed in the front cover 32 now opposes the corresponding protrusion 125 (see FIG. 2), and the protrusion 125 then starts to enter into the space 95A.

As the ink cartridge 30 is inserted further in the mounting direction 51 in the cartridge-receiving section 110, the cap 79 of the ink supply part 34 has been inserted in the guide part 105 and the ink needle 102 has entered deeper into the ink supply port 71 to separate the valve 77 away from the sealing member 76 against the urging force of the coil spring 78. The ink cartridge 30 is therefore applied with the urging force of the coil spring 78 in the removing direction 52.

Further, the IC board 64 comes to a position below the contacts formed on the contact unit 160. Lower ends of the contacts are located below the upper surfaces of the electrodes 65 mounted on the IC board 64 until the IC board 64 reaches below the contacts. Upon arrival of the IC board 64 at the position below the contacts, the IC board 64 pushes the contacts upward while elastically deforming the contacts. The electrodes 65 are thus made in contact with the corresponding contacts. With the contact between the electrodes 65 and the corresponding contacts of the contact unit 160, electrical connection between the IC of the IC board 64 and the controller 1 of the printer 10 can be established. The controller 1 can therefore be made accessible to the IC of the IC board 64.

Further, although not shown in the drawings, when the IC board 64 has arrived below the contacts of the contact unit 160, one of the two protrusions provided on the lower surface of the contact unit 160 has entered into a space formed between the IC board 64 and the first and second protrusions 191R and 192R; and the other one of the two protrusions provided on the lower surface of the contact unit 160 has entered into a space formed between the IC board 64 and the first and second protrusions 191L and 192L.

Further, the projection 43 on the rear cover 31 approaches the lock part 145, and the sloped surface 155 makes sliding contact with the lock part 145.

As the ink cartridge 30 is further inserted into the cartridge-receiving section 110 in the mounting direction 51 against the urging force of the coil spring 78, the sloped surface 155 of the projection 43 moves past the lock part 145 and approaches toward the end wall 117 of the case 101.

At this time, the lock surface 151 of the projection 43 opposes the lock part 145 in the removing direction 52. When the user stops inserting the ink cartridge 30 in the ink cartridge 30, the ink cartridge 30 is moved in the removing direction 52 by the urging force of the coil spring 78. Since the lock surface 151 has opposed the lock part 145 in the removing direction 52, the lock surface 151 is brought into contact with the lock part 145 when the ink cartridge 30 is moved slightly in the removing direction 52. In this way, the ink cartridge 30 is restricted from being moved further in the removing direction 52 by the contact of the lock surface 151 against the lock part 145. Mounting of the ink cartridge 30 into the cartridge-receiving section 110 has been thus completed and the ink cartridge 30 is fixed in position relative to the cartridge-receiving section 110.

For removing the ink cartridge 30 from the cartridge-receiving section 110, the user first pushes the operation part 90 downward. Due to the user's pushing of the operation part 90 in the downward direction 53, the lock surface 151 is moved downward below the lock part 145, thereby allowing the ink cartridge 30 to move in the removing direction 52 by the urging force of the coil spring 78. As a result, at least the rear cover 31 of the ink cartridge 30 can be popped out of the case 101 of the cartridge-receiving section 110 through the opening 112. The user can now hold the rear cover 31 and remove the ink cartridge 30 from the cartridge-receiving section 110.

<Operational and Technical Advantages>

According to the structure of the present embodiment, the first protrusions 191 (191R and 191L) include the second surfaces 184 and 186 that slope away from the IC board 64 toward the protruding ends 181B. Hence, even if the first protrusions 191 were deformed, the deformed first protrusions 191 are less likely to enter into the space between the IC board 64 and the first and second protrusions 191, 192, i.e., into a space in which either the IC board 64 or the contact unit 160 capable of accessing the IC board 64 (specifically, the protrusions on the lower surface of the contact unit 160) is to be disposed.

Further, the protruding ends 181B of the first protrusions 191 are positioned further in the upward direction 54 (upward) relative to the IC board 64 in the embodiment. This structure of the first protrusions 191 can suppress external impacts applied to the ink cartridge 30 in the downward direction 53 from being directly transmitted to the IC board 64.

Further, the six outer surfaces (front wall of the front surface 140, rear surface of the rear surface 41, upper surfaces of the upper walls 39 and 141, bottom surfaces of the bottom walls 42 and 142, right surfaces of the right side walls 37 and 143, and left surfaces of the left side walls 38 and 144) define the external shapes of the rear cover 31 and front cover 32 constituting the ink cartridge 30. Of these six outer surfaces constituting of the contour of the ink cartridge 30, the left surfaces of the left side walls 38, 144 and the right surfaces of the right side surfaces 37 and 143 have the largest area, i.e., the largest area of projection. Accordingly, it is likely that either one of the left side walls 38, 144 and the right side walls 37, 143 will hit on the ground and be applied with an impact, when the ink cartridge 30 is dropped onto the ground.

In the embodiment, the first protrusion 191L is provided at a position closer to the left surfaces of the left side walls 38 and 144 than the IC board 64 is to the left surfaces of the left side walls 38 and 144. Likewise, the first protrusion 191R is provided at a position closer to the right surfaces of the right side walls 37 and 143 than the IC board 64 is to the right surfaces of the right side walls 37 and 143. Accordingly, the first protrusions 191 (first protrusions 191L, 191R) can protect the IC board 64 from the impact when either the left side walls 38 and 144 or the right side walls 37 and 143 collide on the ground. Further, even if the first protrusions 191 were deformed at the time of falling of the ink cartridge 30 onto the ground, the deformed first protrusions 191 are less likely to enter into the space in which the IC board 64 or the contact unit 160 accessible to the IC board 64 are to be located.

Further, since the first protrusions 191 are provided on the right side of the IC board 64 in the rightward direction 55 as well as on the left side of the IC board 64 in the leftward direction 56, this structure can provide protection to the IC board 64 from impacts applied thereto both in the rightward direction 55 and leftward direction 56.

Still further, the distance L1 defined between the rib 161 supporting the first upper wall 146 and the left edge 141L of the upper wall 141 in the rightward direction 55 and leftward direction 56 is shorter than the distance L2 defined between the rib 161 and the right edge 141R of the upper wall 141 in the rightward direction 55 and leftward direction 56. The rib 161 can enhance strength to the first upper wall 146.

The angle θ formed between the imaginary plane 188 including the end face 187 of the first protrusions 191 in the mounting direction 51 and the imaginary plane 189 including the upper surface of the first upper wall 146 is an obtuse angle. Hence, even if the first protrusions 191 are applied with impacts in the removing direction 52 or in the rightward direction 55 and leftward direction 56, the first protrusions 191 are less likely to deform toward the IC board 64.

Further, the second protrusions 192 are also provided on the upper wall 141 (first upper wall 146) of the front cover 32 constituting the ink cartridge 30, in addition to the first protrusions 191 in the embodiment. Accordingly, this structure can provide further protection to the IC board 64. Moreover, the second protrusions 192 are arranged on the right side of the IC board 64 in the rightward direction 55 as well as on the left side of the IC board 64 in leftward direction 56. Hence, this structure can further protect the IC board 64 from impacts applied thereto in the rightward direction 55 and leftward direction 56.

Still further, each of the recesses 193 (193R, 193L) is arranged to be aligned with the IC board 64 in the rightward direction 55 and leftward direction 56. This arrangement of the recesses 193 is beneficial in a configuration that the IC board 64 is attached to the first upper wall 146 or the board support part 130 by ultraviolet cure adhesive, since the recesses 193 can secure a path for ultraviolet light that is irradiated toward the IC board 64 in the rightward direction 55 and leftward direction 56.

Further, in the depicted embodiment, the IC board 64 is slid in the leftward direction 56 and attached to the board support part 130 (upper surface 131) while passing through the recess 193R that is positioned further in the rightward direction 55 (rightward) relative to the IC board 64. At this time, the IC board 64 can be fixed in position relative to the board support part 130 by bringing the end of the IC board 64 in the leftward direction 56 (left end of the IC board 64) into contact with the right surface 121 of the projection 120 constituting the board support part 130. In the present embodiment, the recess 193R formed in the second protrusion 192R has the depth D1 (i.e., depth in the downward direction 53 from the protruding end 182 of the second protrusion 192R) that is deeper than the depth D2 of the recess 193L formed in the second protrusion 192L (i.e., depth in the downward direction 53 from the protruding end 182 of the second protrusion 192L). Accordingly, this structure can facilitate mounting of the IC board 64 onto the board support part 130 and positioning of the IC board 64 relative to the board support part 130.

Modification to the Embodiment

In the above-described embodiment, the ink cartridge 30 has a generally flat shape whose width in the rightward direction 55 and leftward direction 56 is shorter than the height in the downward direction 53 and upward direction 54 and the length in the mounting direction 51 and removing direction 52. However, the ink cartridge 30 may not necessarily have a flat shape.

Figure 7:
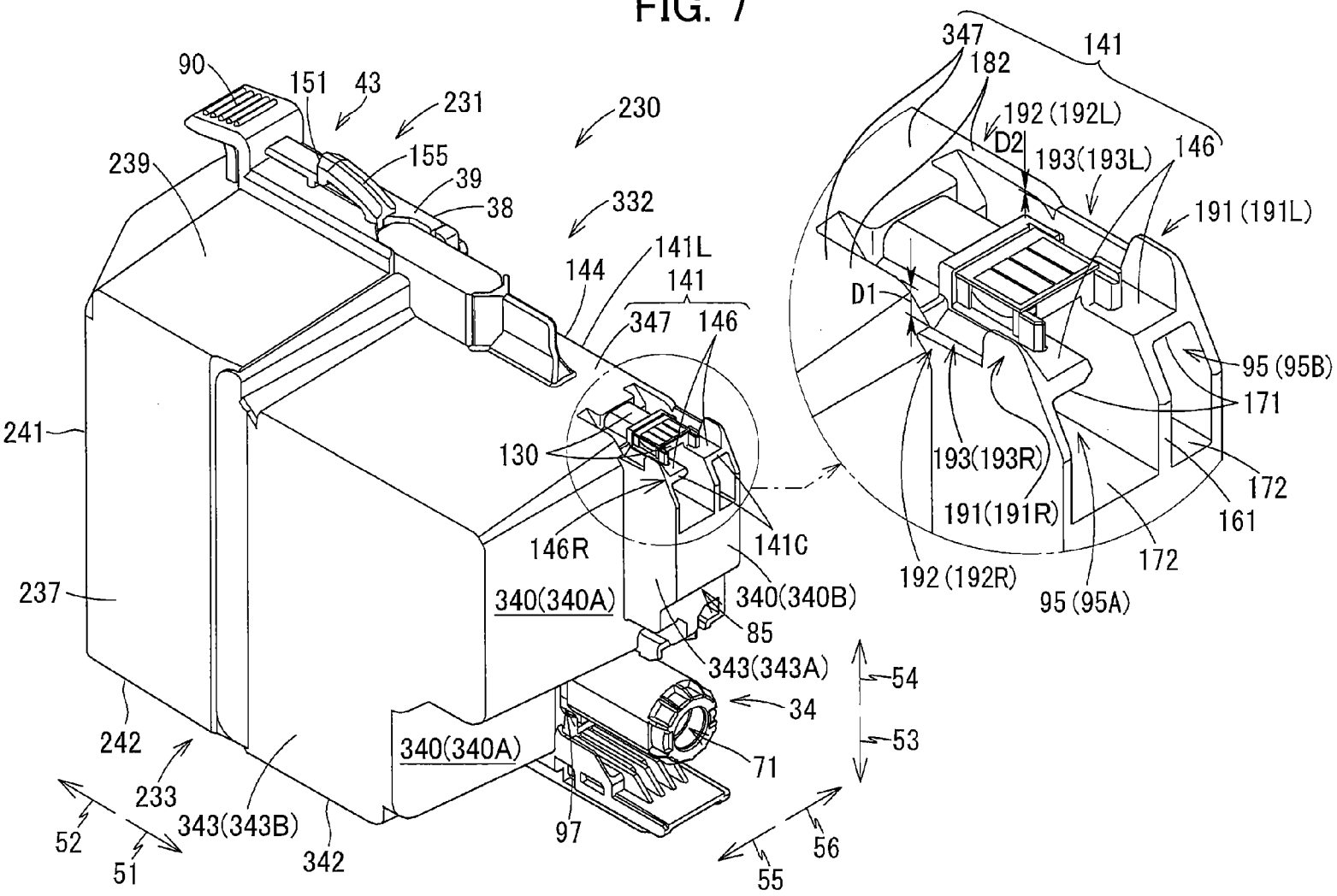
FIG. 7 is a perspective view showing an external appearance of an ink cartridge provided with an extended portion 233 according to a modification to the embodiment.

As an example, FIG. 7 shows an ink cartridge 230 according a modification to the embodiment. The ink cartridge 230 is different from the ink cartridge 30 of the embodiment in that the ink cartridge 230 is provided with an extended portion 233. The extended portion 233 extends from a right end 146R of the first upper wall 146 constituting the upper wall 141. Put another way, the ink cartridge 230 has a larger width in the rightward direction 55 and leftward direction 56 than the ink cartridge 30 of the embodiment by a left-right dimension of the extended portion 233.

Specifically, the ink cartridge 230 includes a rear cover 231 and a front cover 332. The rear cover 231 includes: a rear wall 241 that is extended in the rightward direction 55 relative to the rear wall 41 of the embodiment; an upper wall 239 that is extended in the rightward direction 55 relative to the upper wall 39 of the embodiment; a right side wall 237 that is located further in the rightward direction 55 (rightward) relative to the right side wall 37 in the embodiment; the left side wall 38; a bottom wall 242 that is extended in the rightward direction 55 relative to the bottom wall 42 of the embodiment. Remaining parts of the rear cover 231 have the same structure as those of the rear cover 31 of the embodiment. The front cover 332 includes: a front wall 340 that is extended in the rightward direction 55 relative to the front wall 140 of the embodiment; a second upper wall 347 that is extended in the rightward direction 55 relative to the second upper wall 147 of the embodiment; a bottom wall 342 that is extended in the rightward direction 55 relative to the bottom wall 142 of the embodiment; the left side wall 144; and a right side wall 343 that is located further in the rightward direction 55 (rightward) relative to the right side wall 143 in the embodiment. Remaining parts of the front cover 332 have the same structure as those of the front cover 32 of the embodiment.

Although not shown in FIG. 7, the internal frame 35 of the ink cartridge 230 having the extended portion 233 is also extended in the rightward direction 55 relative to the internal frame 35 of the ink cartridge 30 of the embodiment.

That is, the ink cartridge 230 having the extended portion 233 has a contour (external shape) configured of following six outer surfaces: left surfaces of the left side walls 38 and 144; front surface of the front wall 340; rear surface of the rear wall 241; upper surfaces of the upper wall 239 and second upper wall 347; bottom surfaces of the bottom walls 242 and 342; and right surfaces of the right side walls 237 and 343.

In other words, the extended portion 233 is configured of respective portions of the front wall 340, rear wall 241, upper wall 239, second upper wall 347, and lower walls 242 and 342 that are extended in the rightward direction 55 relative to those in the embodiment; the right side walls 237 and 343; and a portion of the internal frame 35 that is extended in the rightward direction 55. With this structure, the ink chamber 36 defined by the internal frame 35 of the ink cartridge 230 can be made larger than the ink chamber 36 in the ink cartridge 30 of the embodiment. The ink cartridge 230 provided with the extended portion 233 can therefore store a larger amount of ink than the ink cartridge 30 of the embodiment.

The extended portion of the front wall 340 that constitutes the extended portion 233 (rightward portion of the front surface 340) is labelled as 340R in FIG. 7. This rightward portion 340R is located further in the removing direction 52 (i.e., rearward) relative to the recesses 193 of the second protrusions 192 and the IC board 64. Specifically, the front wall 340 is configured of: the rightward portion 340R constituting an end of the extended portion 233 in the mounting direction 51; and a leftward portion 340L constituting the protruding end of the protruding part 85. Hence, the extended portion 233 is positioned further in the removing direction 52 relative to the recesses 193 and the IC board 64.

The right side wall 343 can be divided into two portions 343A and 343B. The portion 343A includes: a portion of the side wall 343 that is disposed further in the mounting direction 51 (frontward) relative to the recesses 193; and a portion of the right side wall 343 located at the same position as the recesses 193 in the mounting direction 51 and removing direction 52. The portion 343B is a portion disposed further in the removing direction 52 (rearward) relative to the recesses 193, meaning that the portion 343B constitutes a portion of the extended portion 233.

In the example of FIG. 7, the depth D1 of the recess 193R formed in the second protrusion 192R in the downward direction 53 is deeper than the depth D2 of the recess 193L of the second protrusion 192L in the downward direction 53, as in the depicted embodiment. That is, of left and right ends of the ink cartridge 230, the depth D2 of the recess 193L formed on the left end of the ink cartridge 230 (i.e., on the side at which the extended portion 233 is not provided) is formed to be shallower than the depth D1 of the recess 193R formed on the right end of the ink cartridge 230 (i.e., on the side at which the extended portion 233 is provided). Put another way, the depth D2 of the recess 193L positioned further in the leftward direction 56 (leftward) relative to the IC board 64 (i.e., the depth in the downward direction 53 from the protruding end 182 of the second protrusion 192L) is formed to be shallower than the depth D1 of the recess 193R positioned further in the rightward direction 55 (rightward) relative to the IC board 64 (i.e., the depth in the downward direction 53 from the protruding end 182 of the second protrusion 192R).

Here, assume that the ink cartridge 230 according to this modification is dropped onto the ground. A larger impact is likely to be imparted on the IC board 64 when the left end of the ink cartridge 230 (at which the extended portion 233 is not provided) is hit against the ground than when the extended portion 233 provided at the right end of the ink cartridge 230 is hit on the ground.

According to the structure of the ink cartridge 230 of this modification, the depth D2 of the recess 193L of the second protrusion 192L located leftward of the IC board 64 in the leftward direction 56 is shallower than the depth D1 of the recess 193R of the second protrusion 192R. Hence, this structure can reliably protect the IC board 64 from the strong impacts that will be imparted thereon when the ink cartridge 230 falls with its left end without the extended portion 233 hit against the ground.

Further, as in the embodiment, the first protrusion 191L is provided at a position closer to the left surfaces of the left side walls 38 and 144 than the IC board 64 is to the left surfaces of the left side walls 38 and 144. Accordingly, the first protrusion 191L can protect the IC board 64 from the impact when the left side walls 38 and 144 collide on the ground. Further, even if the first protrusion 191L were deformed at the time of falling of the ink cartridge 30 onto the ground, the deformed first protrusion 191L is less likely to enter into the space in which the IC board 64 or the contact unit 160 accessible to the IC board 64 are to be located.

Further, as in the embodiment, the distance L1 defined between the rib 161 supporting the first upper wall 146 and the left edge 141L of the upper wall 141 in the rightward direction 55 and leftward direction 56 is shorter than the distance L2 defined between the rib 161 and the right edge 146R (corresponding to right edge 141R in the embodiment) of the upper wall 141 in the rightward direction 55 and leftward direction 56 (refer to FIG. 6). Thus, the rib 161 can support the first upper wall 146 at a position closer to the left side walls 38 and 144 that are susceptible to impacts, thereby enhancing strength of the first upper wall 146.

<Other Variations>

In the depicted embodiment, the board support part 130 is supported by the first upper wall 146. However, the board support part 130 may be supported by the second upper wall 147, rather than the first upper wall 146.

The accessed part of the disclosure is not limited to the IC board 64 of the depicted embodiment. For example, the accessed part may be so configured to be accessed not only by electrically but also by optically or magnetically. One example of such accessed parts may be an optical sensor for detecting an amount of ink that remains in the ink chamber 36.

While the ink cartridge 30 of the embodiment is mounted in the cartridge-receiving section 110 horizontally, the ink cartridge 30 may be configured to move vertically when mounted in the cartridge-receiving section 110.

Further, while ink serves as an example of the liquid in the embodiment, the liquid of the present disclosure is not limited to ink. For example, the liquid may be a pretreatment liquid that is ejected onto sheets prior to ink during a printing operation.

While the invention has been described in detail with reference to the specific embodiment thereof, it would be apparent to those skilled in the art that various changes and modifications may be made therein without departing from the scope of the invention.

What is claimed is:

1. A liquid cartridge comprising:

a cartridge body having a first surface facing in a first direction, the first surface having a first end in a second direction orthogonal to the first direction and a second end in a third direction opposite the second direction;

an accessed part disposed on the first surface and configured to be accessed from outside; and a first protrusion disposed on the first surface at a position closer to the first end than the accessed part is to the first end, the first protrusion protruding from the first surface in the first direction and having a first protruding end positioned further in the first direction relative to the accessed part, the first protrusion being tapered toward the first protruding end, the first protrusion having an inner surface and an outer surface positioned opposite to each other in the third direction, the inner surface being positioned closer to the accessed part than the outer surface is to the accessed part in the third direction, the inner surface being sloped relative to the first direction to extend away from the accessed part toward the first protruding end.

2. The liquid cartridge as claimed in claim 1, wherein the cartridge body is defined by a plurality of outer surfaces including a second surface, the second surface extending from the first end in an opposing direction opposite the first direction and having a largest area among the outer surfaces.

3. The liquid cartridge as claimed in claim 2, wherein the first protrusion comprises a pair of first protrusions, one of the pair of first protrusions being disposed further in the second direction relative to the accessed part and a remaining one of the pair of first protrusions being disposed further in the third direction relative to the accessed part.

4. The liquid cartridge as claimed in claim 3, wherein the cartridge body further comprises:

a first wall having the first surface; and a rib supporting the first wall and arranged further in the opposing direction relative to the first surface, wherein the rib and the first end define a first distance therebetween in the second direction and the rib and the second end define a second distance therebetween in the second direction, the first distance being shorter than the second distance.

5. The liquid cartridge as claimed in claim 1, wherein the first surface extends in a fourth direction orthogonal to the first direction and the second direction and has a third end in the fourth direction, and wherein the first protrusion is arranged on the third end of the first surface and has an end face in the fourth direction, a first imaginary plane including the end face of the first protrusion and a second imaginary plane including the first surface forming an obtuse angle therebetween.

6. The liquid cartridge as claimed in claim 1, further comprising a support part formed on the first surface and supporting the accessed part, wherein the accessed part is a substrate extending in a fourth direction orthogonal to the first direction and the second direction, the substrate having a mount surface facing in the first direction, the accessed part including an electrical interface mounted on the mount surface to allow an electrical access to the accessed part from outside, the circuit substrate having one end in the second direction, and wherein the support part includes a positioning surface extending in the first direction and the fourth direction and facing in the third direction, the one end of the circuit substrate in the second direction being in contact with the positioning surface.

7. The liquid cartridge as claimed in claim 1, further comprising a pair of second protrusions arranged on the first surface and protruding in the first direction, one of the second protrusions being disposed further in the second direction relative to the accessed part and another one of the second protrusions being disposed further in the third direction relative to the accessed part, wherein the accessed part extends in a fourth direction orthogonal to the first direction and the second direction, the second protrusions extending in the fourth direction and having a portion aligned with the accessed part in the second direction.

8. The liquid cartridge as claimed in claim 7, wherein each of the second protrusions has a second protruding end in the first direction and is formed with a recess recessed from the second protruding end in an opposing direction opposite the first direction, the recess being aligned with the accessed part in the second direction and in the third direction.

9. The liquid cartridge as claimed in claim 8, wherein the cartridge body further comprises:

a first wall having the first surface; and an extended part extending in the third direction from the second end of the first wall, the extended part being positioned further in a direction opposite the fourth direction relative to the recess and the accessed part, and wherein the recess formed in the second protrusion disposed further in the second direction relative to the accessed part has a depth from the second protruding end that is shallower than a depth of the recess formed in the second protrusion disposed further in the third direction relative to the accessed part.

10. The liquid cartridge as claimed in claim 9, further comprising a support part formed on the first surface and supporting the accessed part, wherein the accessed part is a circuit substrate having a mount surface facing in the first direction, the accessed part including an electrical interface mounted on the mount surface to allow an electrical access to the accessed part from outside, the circuit substrate having one end in the second direction, and wherein the support part includes a positioning surface extending in the first direction and the fourth direction and facing in the third direction, the one end of the circuit substrate in the second direction being in contact with the positioning surface.

11. The liquid cartridge according to claim 1, wherein the accessed part is a substrate having a mount surface facing in the first direction, the accessed part including an electrical interface mounted on the mount surface to allow an electrical access to the accessed part from outside.

12. The liquid cartridge as claimed in claim 1, further comprising a liquid supply part, wherein the cartridge body further includes a third surface orthogonal to the first surface, the liquid supply part being disposed at the third surface, the second direction and the third direction being parallel to the third surface.

13. A liquid cartridge comprising:

a front surface;

a rear face opposite the front surface;

an upper surface extending between the front surface and the rear surface, the upper surface facing in a first direction;

a first side surface extending between the front surface and the rear surface, the first side surface facing in a second direction orthogonal to the first direction;

a second side surface opposite the first side surface and facing in a third direction opposite the second direction;

an accessed part disposed on the upper surface and configured to be accessed from outside, the accessed part having an accessed surface facing in the first direction; and a first protrusion disposed on the upper surface at a position closer to the first side surface than the accessed part is to the first side surface, the first protrusion having a base end connected to the upper surface and a protruding end opposite the base end, the first protrusion having an inner surface and an outer surface connecting the base end and the protruding end, the inner surface being positioned closer to the accessed part than the outer surface is to the accessed part in the third direction, the first protrusion being tapered from the base end toward the protruding end such that a distance between the inner surface and the accessed part in the third direction increases with distance from the base end toward the protruding end.

14. The liquid cartridge as claimed in claim 13, further comprising a bottom surface opposite the upper surface and extending between the front surface and the rear surface, wherein the first side surface and the second side surface have an area larger than areas of the front surface, the rear surface, the upper surface and the bottom surface.

15. The liquid cartridge as claimed in claim 14, wherein the first protrusion comprises a pair of first protrusions, one of the pair of first protrusions being disposed further in the second direction relative to the accessed part and a remaining one of the pair of first protrusions being disposed further in the third direction relative to the accessed part.

16. The liquid cartridge as claimed in claim 15, further comprising:

an upper wall having the upper surface, the upper surface having a first end in the second direction and a second end in the third direction; and a rib supporting the upper wall and arranged further in an opposing direction opposite the first direction relative to the upper surface, wherein the rib and the first end define a first distance therebetween in the second direction and the rib and the second end define a second distance therebetween in the second direction, the first distance being shorter than the second distance.

17. The liquid cartridge as claimed in claim 13, wherein the upper surface extends in a fourth direction orthogonal to the first direction and the second direction and has a third end in the fourth direction, and wherein the first protrusion is arranged on the third end of the upper surface and has an end face in the fourth direction, a first imaginary plane including the end face of the first protrusion and a second imaginary plane including the upper surface forming an obtuse angle therebetween.

18. The liquid cartridge as claimed in claim 13, further comprising a support part formed on the upper surface and supporting the accessed part, wherein the accessed part is a substrate extending in a fourth direction orthogonal to the first direction and the second direction, the substrate having the accessed surface, the accessed part including an electrical interface mounted on the accessed surface to allow an electrical access to the accessed part from outside, the circuit substrate having one end in the second direction, and wherein the support part includes a positioning surface extending in the first direction and the fourth direction and facing in the third direction, the one end of the circuit substrate in the second direction being in contact with the positioning surface.

19. The liquid cartridge as claimed in claim 13, further comprising a pair of second protrusions arranged on the upper surface and protruding in the first direction, one of the second protrusions being disposed further in the second direction relative to the accessed part and another one of the second protrusions being disposed further in the third direction relative to the accessed part, wherein the accessed part extends in a fourth direction orthogonal to the first direction and the second direction, the second protrusions extending in the fourth direction and having a portion aligned with the accessed part in the second direction.

20. The liquid cartridge as claimed in claim 19, wherein each of the second protrusions has a second protruding end in the first direction and is formed with a recess recessed from the second protruding end in an opposing direction opposite the first direction, the recess being aligned with the accessed part in the second direction and in the third direction.

21. The liquid cartridge as claimed in claim 20, further comprising:

an upper wall having the upper surface, the upper surface having a first end in the second direction and a second end in the third direction; and an extended part extending in the third direction from the second end, the extended part being positioned further in a direction opposite the fourth direction relative to the recess and the accessed part, and wherein the recess formed in the second protrusion disposed further in the second direction relative to the accessed part has a depth from the second protruding end that is shallower than a depth of the recess formed in the second protrusion disposed further in the third direction relative to the accessed part.

22. The liquid cartridge as claimed in claim 21, further comprising a support part formed on the upper surface and supporting the accessed part, wherein the accessed part is a substrate having the accessed surface, the accessed part including an electrical interface mounted on the accessed surface to allow an electrical access to the accessed part from outside, the circuit substrate having one end in the second direction, and wherein the support part includes a positioning surface extending in the first direction and the fourth direction and facing in the third direction, the one end of the circuit substrate in the second direction being in contact with the positioning surface.

23. The liquid cartridge as claimed in claim 13, further comprising a liquid supply part disposed at the front surface, wherein the second direction and the third direction are parallel to the front surface.

* * * * *